US005229261A

United States Patent [19]

Ogawa et al.

[11] Patent Number: 5,229,261

[45] Date of Patent: Jul. 20, 1993

[54] SILVER HALIDE PHOTOGRAPHIC MATERIAL

[75] Inventors: Tadashi Ogawa; Nobuo Furutachi, both of Kanagawa, Japan

[73] Assignee: Fuji Photo Film Co., Ltd., Kanagawa, Japan

[21] Appl. No.: 758,430

[22] Filed: Sep. 3, 1991

Related U.S. Application Data

[63] Continuation of Ser. No. 275,630, Nov. 16, 1988, abandoned, which is a continuation of Ser. No. 919,536, Oct. 16, 1986, abandoned.

[30] Foreign Application Priority Data

Oct. 18, 1985 [JP] Japan ..... 60-232629

[51] Int. Cl.[5] ..... G03C 7/38

[52] U.S. Cl. ..... 430/558; 430/567

[58] Field of Search ..... 430/558, 551, 567

[56] References Cited

U.S. PATENT DOCUMENTS

| | | | |
|---|---|---|---|
| 4,522,916 | 6/1985 | Hirano | 430/558 |
| 4,623,617 | 11/1986 | Kaneko et al. | 430/551 |
| 4,665,015 | 5/1987 | Iijima et al. | 430/558 |
| 4,710,453 | 12/1987 | Hirabayashi et al. | 430/505 |
| 4,882,266 | 11/1989 | Kawagishi et al. | 430/558 |

FOREIGN PATENT DOCUMENTS

| | | | |
|---|---|---|---|
| 0178165 | 4/1986 | European Pat. Off. | 430/558 |
| 0178789 | 4/1986 | European Pat. Off. | 430/558 |
| 193397 | 9/1986 | European Pat. Off. . | |

*Primary Examiner*—Lee C. Wright

*Attorney, Agent, or Firm*—Sughrue, Mion, Zinn, Macpeak & Seas

[57] ABSTRACT

A silver halide color photographic material, which comprises a support and a silver halide emulsion layer, contains a pyrazoloazole type coupler represented by the following general formula (II) in the emulsion layer, to ensure high sensitivity and high gamma without attended by increase in fog:

(II)

wherein $R_1$ represents a hydrogen atom or a substituent group; X represents a hydrogen atom or a group releasable upon coupling with the oxidation product of an aromatic primary amine developing agent; or —NH—; Zb and Zc also represent a methine group, a substituted methine group, =N— or —NH—, wherein the substituent of at least either of Zb and Zc is a tertiary alkyl group represented by provided that when Zc is the above-described substituted methine group having the tertiary alkyl group as a substituent, $R_1$ is not such a tertiary alkyl group, and when Zb represents the above-described substituted methine group, either Za or Zc is —NH— and the remainder is a methine group, a substituted methine group or =NH—, while when Zc represents the above-described substituted methine group, Za is —NH— and Zb is a methine group, a substituted methine group or =N—. $R_2$ represents an alkyl group or a halogen atom; and $R_3$ and $R_4$ each represents substituents as defined in the specification.

5 Claims, No Drawings

SILVER HALIDE PHOTOGRAPHIC MATERIAL

This is a continuation of application Ser. No. 07/275,630, filed Nov. 16, 1988, now abandoned, which is a continuation of application Ser. No. 06/919,536, filed Oct. 16, 1986, now abandoned.

FIELD OF THE INVENTION

The present invention relates to a silver halide photographic material and, more particularly, to a silver halide photographic material excellent in color reproducibility, photographic speed, and processing characteristics.

BACKGROUND OF THE INVENTION

Color images are well known to be formed by reacting couplers with color developing agents of aromatic primary amine type which have been oxidized by optically exposed silver halides, which function as oxidizing agent to produce indophenol, indoaniline, indamine, azomethine, phenoxazine, phenazine and their analogous dyes.

Most of the magenta color image-forming couplers which have widely been submitted to practical use up to the present, studies of which have been proceeded, are 5-pyrazolones. The 5-pyrazolone couplers are excellent in dye-forming speed and efficiency and, moreover, the azomethine dyes produced therefrom are excellent in fastness to light and heat. However, it is also known that such azomethine dyes have absorption of a yellow component in the neighborhood of 430 nm, which is undesirable as a magenta dye and responsible for color turbidity.

As a result of seeking after magenta color image-forming coupler nuclei which enable reduction of this yellow component, pyrazolobenzimidazole nuclei described in British Patent 1,047,612, pyrazolotriazole nuclei described in U.S. Pat. No. 3,725,067, pyrazoloimidazole nuclei described in U.S. Pat. No. 4,500,630, pyrazolopyrazole nuclei described in Japanese Patent Application (OPI) No. 43659/85 (the term "OPI" as used herein refers to a "published unexamined Japanese patent application"), and pyrazolotriazole nuclei described in European Patent 119,860A have been developed.

All of the dyes formed from these nuclei are superior to those formed from the former 5-pyrazolones in respect of unnecessary absorption of the yellow component, and, further, they are desirable from the viewpoint of color reproducibility, for the absorption on the long wavelength side in their absorption spectra descends sharply to the zero level.

However, we have found that these pyrazoloazole couplers, though superior in the above-described respects, are possessed of undesirable properties as described below.

Namely, when these couplers are present together with silver halides to function as oxidizing agent for an aromatic primary amine developing agent, more specifically when emulsified dispersions of these couplers and silver halide emulsions are mixed, coated on supports respectively, and examined for photographic properties, the silver halide emulsions used cannot manifest their intrinsic sensitivity, gradation and fog. That is, some emulsions undergo sensitization, some emulsions undergo desensitization, and the others undergo decrease in color density of developed images. These behaviors can be ascertained, e.g., by comparing with the result of color development or black-and-white development conducted in the emulsion-coated sample in which a 5-pyrazolone type coupler is incorporated under the same condition as pyrazoloazole type couplers. Also, part of the above-described phenomena can be understood by preparing a coat which contains a silver halide emulsion alone and does not contain any couplers, and comparing the result of black-and-white development of the coat with that of a silver halide emulsion coat containing a pyrazoloazole type coupler.

In the nature of things, couplers to be employed in silver halide color photographic materials, exclusive of development inhibitor releasing couplers and development accelerator releasing couplers, are not expected to exert any actions on silver halide emulsions, and are not desired to produce a sensitization, desensitization or like effect by acting particularly on the sensitization process.

The above-described actions on silver halides were found to be hardly caused by 5-pyrazolone couplers which have prevailingly been put to practical use as magenta color image-forming coupler up to the present, whereas such actions have turned out to be extensively observed in case of pyrazoloazole couplers.

The pyrazoloazole couplers are couplers having a pyrazolobenzimidazole ring, a pyrazolotriazole ring or the like. We have confirmed that compounds containing residues of these rings have stronger interaction upon silver ion or silver halide, more specifically complexation power thereover or adsorptive activity thereon, compared with compounds containing residues of 5-pyrazolones which have widely used as magenta coupler up to the present. Further, it has also been ascertained that these interactions result in sensitization, desensitization or drop in color formability.

Variations of interaction between a silver halide emulsion and a pyrazoloazole coupler with the kind of halide contained in the emulsion were examined using samples prepared by coating combinations of various kinds of silver halide emulsions and a pyrazoloazole coupler on separate supports. As a result of these examinations, it has turned out that the pyrazoloazole coupler is more liable to cause the drop in color formability in a silver chloride emulsion than in a silver bromide emulsion. Moreover, it has been found that a silver iodobromide emulsion which contains silver iodide is more difficult to undergo the lowering of color formability than a silver bromide emulsion and a silver chlorobromide emulsion. That is, there was a greater interaction between a silver chlorobromide emulsion and a pyrazoloazole coupler than between a silver iodobromide emulsion and a pyrazoloazole coupler in regard to drop in color formability. Therefore, it was still more difficult to introduce a pyrazoloazole coupler into a light-sensitive material when a silver chlorobromide emulsion was used therein.

As a means for solving the above-described problem, the method of properly controlling pH of the emulsion coat is disclosed in Japanese Patent Application No. 162874/85. Although this method is very effective in severing the above-described interaction, it contains the following insufficiency. Even if the interaction inside the emulsion coat as it is can be cut off by previously controlling pH of the emulsion coat, the emulsion coat must be submitted to color development processing in order to make the emulsion coat develop a color. In the color development, it is, in general, to soak the light-sensitive material in a developer exhibiting pH ranging from about 9 to about 12 and, thereby, the pH of the emulsion coat increases sharply, and the interaction is newly generated in the processing solution. This interaction also is strong in case of silver chlorobromide.

It is important at any rate to cut off the actions of pyrazoloazoles upon silver halides, particularly silver chlorobromide, and it is expected to bring about improvements upon methods for cutting off the interaction between silver halides and pyrazoloazoles.

SUMMARY OF THE INVENTION

Therefore, a first object of the present invention is to provide a silver halide photographic material excellent in color reproducibility, sensitivity and color density of the developed image.

A second object of the present invention is to provide a silver halide photographic material which contains a pyrazoloazole coupler, and what is more, possesses high sensitivity and ensures high color density of the developed image.

The above-described objects are attained with a silver halide color photographic material which comprises a support having provided thereon a silver halide emulsion layer containing a pyrazoloazole coupler represented by general formula (I):

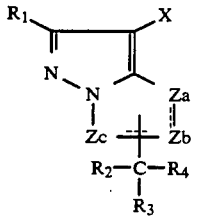

(I)

wherein $R_1$ represents a hydrogen atom or a substituent group; X represents a hydrogen atom or a group releasable upon coupling with the oxidation product of an aromatic primary amine developing agent; Za represents a methine group, a substituted methine group, =N— or —NH—; Zb and Zc also represent a methine group, a substituted methine group, =N— or —NH—, provided that at least either of them is the substituted methine group wherein the substituent is a

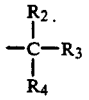

group, preferably wherein the substituent of at least either of Zb and Zc is a tertiary alkyl group represented by

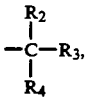

provided that when Zc is the above-described substituted methine group having the tertiary alkyl group as a substituent, $R_1$ is not such a tertiary alkyl group, and when Zb represents the above-described substituted methine group either Za or Zc is —NH— and the remainder is a methine group, a substituted methine group or =N—, while when Zc represents the above-described substituted methine group Za is —NH— and Zb is a methine group, a substituted methine group or =N—; $R_2$ represents an alkyl group or a halogen atom; and $R_3$ and $R_4$ each represents a halogen atom, an alkyl group, an aryl group, a heterocyclic group, a cyano group, a hydroxyl group, an alkoxy group, an aryloxy group, a heterocyclic oxy group, an acyloxy group, a carbamoyloxy group, a silyloxy group, a sulfonyloxy group, an acylamino group, an anilino group, an amino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carboxyl group, a carbamoyl group, an acyl group, a sulfamoyl group, a sulfonyl group, a sulfinyl group, an alkoxycarbonyl group or an aryloxycarbonyl group.

DETAILED DESCRIPTION OF THE INVENTION

The above-mentioned tertiary alkyl group is an alkyl group having no hydrogen atom bonded to the carbon atom directly connected to the pyrazoloazole nucleus.

Of the magenta couplers of the pyrazoloazole type represented by general formula (I), those represented by general formulae (II) to (VI) are preferred over others:

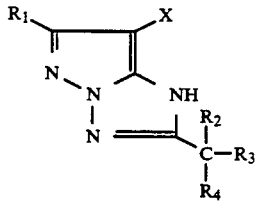

(II)

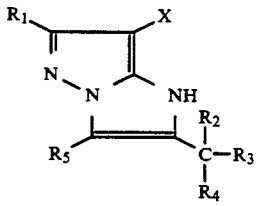

(III)

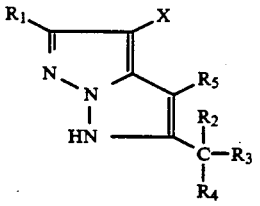

(IV)

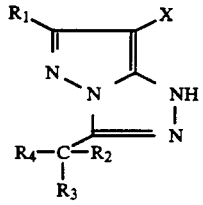

(V)

-continued

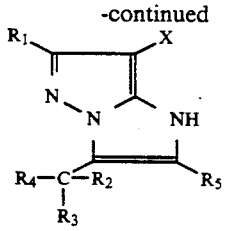

(VI)

In the foregoing formulae, $R_2$ may represent either a straight or branched chain alkyl group, with specific examples including a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a cyclopentyl group, a cyclohexyl group and so on. Substituent groups like these alkyl groups, and an alkyl group, an alkoxy group, an aryl group and other groups described hereinafter may further contain one or more of a substituent group. Suitable examples of such a substituent group include halogen atoms (e.g., a fluorine atom, a chlorine atom, etc.), alkyl groups (e.g., a methyl group, an ethyl group, a propyl group, a 2,2-dimethylpropyl group, an n-butyl group, a t-butyl group, a trifluoromethyl group, a tridecyl group, a 3-(2,4-di-t-amylphenoxy)propyl group, an allyl group, a 2-dodecyloxyethyl group, a 3-phenoxypropyl group, a 2-hexylsulfonylethyl group, a cyclopentyl group, a benzyl group, etc.), alkenyl groups (e.g., a vinyl group, etc.), alkynyl groups (e.g., a 1-propynyl group, etc.), aryl groups (e.g., a phenyl group, a 4-t-butylphenyl group, a 2,4-di-t-amylphenyl group, a 4-tetradecanamidophenyl group, etc.), heterocyclic groups (e.g., a 2-furyl group, a 2-thienyl group, a 2-pyrimidinyl group, a 2-benzothiazolyl group, etc.), a cyano group, a hydroxyl group, alkoxy groups (e.g., a methoxy group, an ethoxy group, a 2-methoxyethoxy group, a 2-dodecyloxyethoxy group, a 2-methanesulfonylethoxy group, etc.), aryloxy groups (e.g., a phenoxy group, a 2-methylphenoxy group, a 4-t-butylphenoxy group, etc.), heterocyclic oxy groups (e.g., a 2-benzimidazolyloxy group, etc.), acyloxy groups (e.g., an acetoxy group, a hexadecanoyloxy group, etc.), carbamoyloxy groups (e.g., an N-phenylcarbamoyloxy group, an N-ethylcarbamoyloxy group, etc.), silyloxy groups (e.g., a trimethylsilyloxy group, etc.), sulfonyloxy groups (e.g., a dodecylsulfonyloxy group, etc.), acylamino groups (e.g., an acetamido group, a benzamido group, a tetradecanamido group, an α-(2,4-di-t-amylphenoxy)butyramido group, a γ-(3-t-butyl-4-hydroxyphenoxy)butyramido group, an α-[4-(4-hydroxyphenylsulfonyl)phenoxy]decanamido group, etc.), anilino groups (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), amino groups (e.g., an ethylamino group, a dimethylamino group, a methyloctylamino group, etc.), ureido groups (e.g., a phenylureido group, a methylureido group, an N,N-dibutylureido group, etc.), imido groups (e.g., an N-succinimido group, a 3-benzylhydantoinyl group, a 4-(2-ethylhexanoylamino)phthalimido group, etc.), sulfamoylamino groups (e.g., an N,N-dipropylsulfamoylamino group, an N-methyl-N-decylsulfamoylamino group, etc.), alkylthio groups (e.g., a methylthio group, an octylthio group, a tetradecylthio group, a 2-phenoxyethylthio group, a 3-phenoxypropylthio group, a 3-(4-t-butylphenoxy)propylthio group, etc.), arylthio groups (e.g., a phenylthio group, a 2-butoxy-5-t-octylphenylthio group, a 3-pentadecylphenylthio group, a 2-carboxyphenylthio group, a 4-tetradecanamidophenylthio group, etc.), heterocyclic thio groups (e.g., a 2-benzothiazolylthio group, etc.), alkoxycarbonylamino groups (e.g., a methoxycarbonylamino group, a tetradecyloxycarbonylamino group, etc.), aryloxycarbonylamino groups (e.g., a phenoxycarbonylamino group, a 2,4-di-t-butylphenoxycarbonylamino group, etc.), sulfonamido groups (e.g., a methanesulfonamido group, a hexadecanesulfonamido group, a benzenesulfonamido group, a p-toluenesulfonamido group, an octadecanesulfonamido group, a 2-methoxy-5-t-butylbenzenesulfonamido group, etc.), a carboxyl group, carbamoyl groups (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-t-amylphenoxy)propyl]carbamoyl group, etc.), acyl groups (e.g., an acetyl group, a 2,4-di-t-amylphenoxyacetyl group, a benzoyl group, etc.), sulfamoyl groups (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), sulfonyl groups (e.g., a methanesulfonyl group, an octanesulfonyl group, a benzenesulfonyl group, a toluenesulfonyl group, etc.), sulfinyl groups (e.g., an octanesulfinyl group, a dodecylsulfinyl group, a phenylsulfinyl group, etc.), alkoxycarbonyl groups (e.g., a methoxycarbonyl group, a butyloxycarbonyl group, a dodecylcarbonyl group, an octadecylcarbonyl group, etc.), aryloxycarbonyl groups (e.g., a phenyloxycarbonyl group, a 3-pentadecyloxycarbonyl group, etc.), and so on. In addition, $R_2$ can represent a halogen atom.

$R_3$ and $R_4$ each represents a halogen atom, an alkyl group, an aryl group, a heterocyclic group, a cyano group, a hydroxyl group, an alkoxy group, an aryloxy group, a heterocyclic oxy group, an acyloxy group, a carbamoyloxy group, a silyloxy group, a sulfonyloxy group, an acylamino group, an anilino group, an amino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carboxyl group, a carbamoyl group, an acyl group, a sulfamoyl group, a sulfonyl group, a sulfinyl group, an alkoxycarbonyl group, or an aryloxycarbonyl group. More specifically, substituent groups represented by $R_3$ and $R_4$ include halogen atoms (e.g., a fluorine atom, a chlorine atom, etc.), alkyl groups (e.g., a methyl group, an ethyl group, a propyl group, a 2,2-dimethylpropyl group, an n-butyl group, a t-butyl group, a trifluoromethyl group, a tridecyl group, a 3-(2,4-di-t-amylphenoxy)propyl group, an allyl group, a 2-dodecyloxyethyl group, a 3-phenoxypropyl group, a 2-hexylsulfonylethyl group, a cyclopentyl group, a benzyl group, etc.), aryl groups (e.g., a phenyl group, a 4-t-butylphenyl group, a 2,4-di-t-amylphenyl group, a 4-tetradecanamidophenyl group, etc.), heterocyclic groups (e.g., a 2-furyl group, a 2-thienyl group, a 2-pyrimidinyl group, a 2-benzothiazolyl group, etc.), a cyano group, a hydroxyl group, alkoxy groups (e.g., a methoxy group, an ethoxy group, a 2-methoxyethoxy group, a 2-dodecyloxyethoxy group, a 2-methanesulfonylethoxy group, etc.), aryloxy groups (e.g., a phenoxy group, a 2-methylphenoxy group, a 4-t-butylphenoxy group, etc.), heterocyclic oxy groups (e.g., a 2-benzimidazolyloxy group, etc.), acyloxy groups (e.g., an acetoxy group, a hexadecanoyloxy group, etc.), carbamoyloxy groups (e.g., an N-phenylcarbamoyloxy group, an N-ethylcarbamoyloxy group, etc.), silyloxy groups (e.g., a trimethylsilyloxy group, etc.), sulfonyloxy groups (e.g., a dodecylsulfonyloxy group, etc.), acylamino groups (e.g., an acetamido group, a benzamido group, a tetradecanamido group, an α-(2,4-di-t-amylphenoxy)butyramido group, a γ-(3-t-butyl-4-hydroxyphenoxy)butyramido group, an α-[4-(4-hydroxyphenylsulfonyl)phenoxy]decanamido group, etc.), anilino groups (e.g., a phenylanilino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), amino groups (e.g., an ethylamino group, a dimethylamino group, a methyloctylamino group, etc.), ureido groups (e.g., a phenylureido group, a methylureido group, an N,N-dibutylureido group, etc.), imido groups (e.g., an N-succinimido group, a 3-benzylhydantoinyl group, a 4-(2-ethylhexanoylamino)phthalimido group, etc.), sulfamoylamino groups (e.g., an N,N-dipropylsulfamoylamino group, an N-methyl-N-decylsulfamoylamino group, etc.), alkylthio groups (e.g., a methylthio group, an octylthio group, a tetradecylthio group, a 2-phenoxyethylthio group, a 3-phenoxypropylthio group, a 3-(4-t-butylphenoxy)propylthio group, etc.), arylthio groups (e.g., a phenylthio group, a 2-butoxy-5-t-octylphenylthio group, a 3-pentadecylphenylthio group, a 2-carboxyphenylthio group, a 4-tetradecanamidophenylthio group, etc. , heterocyclic thio groups (e.g., a 2-benzothiazolylthio group, etc.), alkoxycarbonylamino groups (e.g., a methoxycarbonylamino group, a tetradecyloxycarbonylamino group, etc.), aryloxycarbonylamino groups (e.g., a phenoxycarbonylamino group, a 2,4-di-t-butylphenoxycarbonylamino group, etc.), sulfonamido groups (e.g., a methanesulfonamido group, a hexadecanesulfonamido group, a benzenesulfonamido group, a p-toluenesulfonamido group, an octadecanesulfonamido group, a 2-methoxy-5-t-butylbenzenesulfonamido group, etc.), a carboxyl group, carbamoyl groups (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-t-amylphenoxy)propyl]carbamoyl group, etc.), acyl groups (e.g., an acetyl group, a 2,4-di-t-amylphenoxyacetyl group, a benzoyl group, etc.), sulfamoyl groups (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), sulfonyl groups (e.g., a methanesulfonyl group, an octanesulfonyl group, a benzenesulfonyl group, a toluenesulfonyl group, etc.), sulfinyl groups (e.g., an octanesulfinyl group, a dodecylsulfinyl group, a phenylsulfinyl group, etc.), alkoxycarbonyl groups (e.g., a methoxycarbonyl group, a butyloxycarbonyl group, a dodecylcarbonyl group, an octadecylcarbonyl group, etc.), and aryloxycarbonyl groups (e.g., a phenyloxycarbonyl group, a 3-pentadecyloxycarbonyl group, etc.).

X represents a hydrogen atom, a halogen atom (e.g., a chlorine atom, a bromine atom, and an iodine atom), —COOM (wherein M represents a hydrogen atom or an alkyl metal), a group containing an oxygen linkage (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, and a 2-benzothiazolyloxy group), a group containing a nitrogen linkage (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolydinyl group, a 1-benzylethoxy-3-hydantoinyl group, a 2N-1,1-dioxo-3-(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazole-1-yl group, a 5- or 6-bromobenzotriazole-1-yl group, a 5-methyl-1,2,3,4-triazole-1-yl group, a benzimidazolyl group, a 3-benzyl-1-hydantoinyl group, a 1-benzyl-5-hexadecyloxy-3-hydantoinyl group, and a 5-methyl-1-tetrazolyl group, an arylazo group such as a 4-methoxyphenylazo group, a 4-pivaloylaminophenylazo group, a 2-naphthylazo group, and a 3-methyl-4-hydroxyphenylazo group), or a group containing a sulfur linkage (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, and a 2-phenyl-3-dodecyl-1,2,4-triazole-5-thio group.

$R_5$ in general formulae (III), (IV) and (VI) represents a hydrogen atom or a substituent group. Such a substituent group includes those represented by $R_3$ and $R_4$, which are set forth previously.

$R_1$ in general formula (I) and further in general formulae (II) to (VI) represents a hydrogen atom or a substituent group. Such a substituent group includes those represented by $R_2$, $R_3$ and $R_4$, which are described previously, and further those having the formula

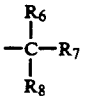

(wherein $R_6$ has the same meaning as $R_2$ described previously, and $R_7$ and $R_8$ have the same meaning as $R_3$ and $R_4$, respectively, which are also described previously, except that any one of the substituents $R_6$, $R_7$ and $R_8$ may be a hydrogen atom, differing from the combination of $R_2$, $R_3$ and $R_4$). In the present invention, a group preferred as $R_1$ is

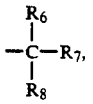

wherein it is particularly desirable that none of the substituents $R_6$, $R_7$ and $R_8$ are hydrogen atom in general formula (II).

Among couplers according to the present invention, most preferred couplers are those represented by general formulae (II) and (V) wherein $R_2$ and $R_4$, which are the same or different, each represents an unsubstituted alkyl group and R represents a substituted or unsubstituted alkyl group, provided that $R_1$ is not a tertiary alkyl group in general formula (V). Preferred examples of the substituent of the substituted alkyl group include a sulfonamido group, an acylamino group and an aryl group each of which may further have a substituent or substituents.

In particular, when silver halides having a chloride content of 10 mol % or more are employed, good results can be obtained, provided that $R_1$ is

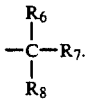

In the case of silver bromide, particularly silver bromide having some iodide content, relatively good properties can be achieved even if $R_1$ is not always

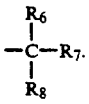

Of the pyrazoloazole couplers illustrated hereinbefore, the couplers represented by general formulae (II) and (V) are particularly preferred over others.

Specific examples of representative magenta couplers according to the present invention are illustrated below. However, the present invention should not be construed as being limited to these examples.

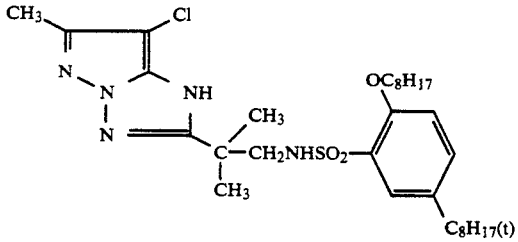

(M-1)

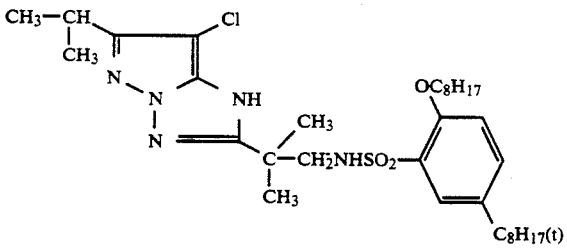

(M-2)

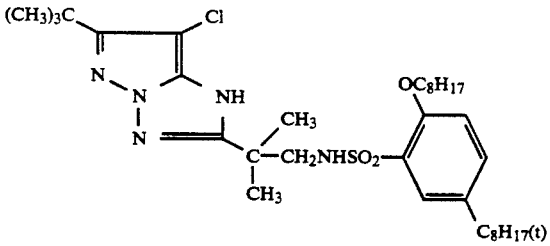

(M-3)

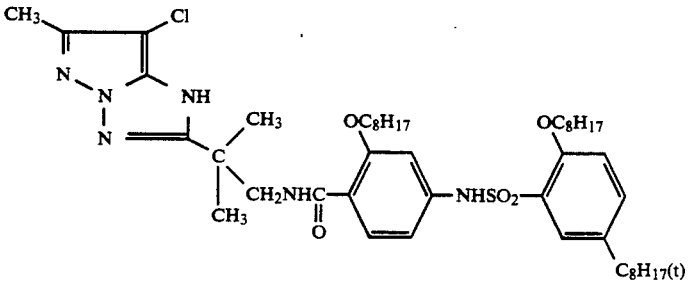

(M-4)

-continued
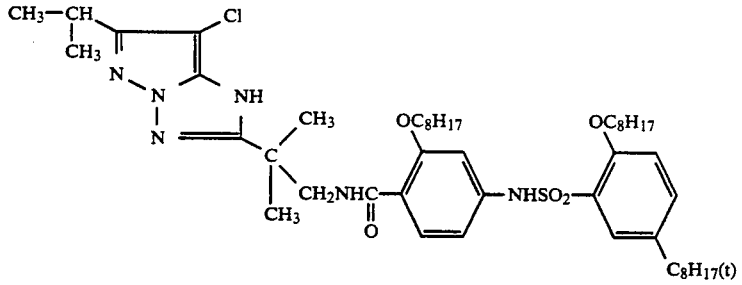
(M-5)
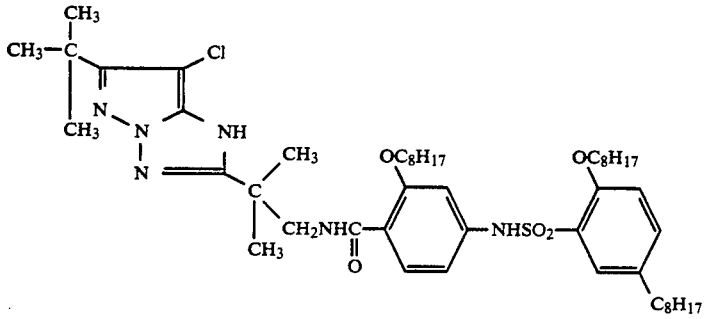
(M-6)
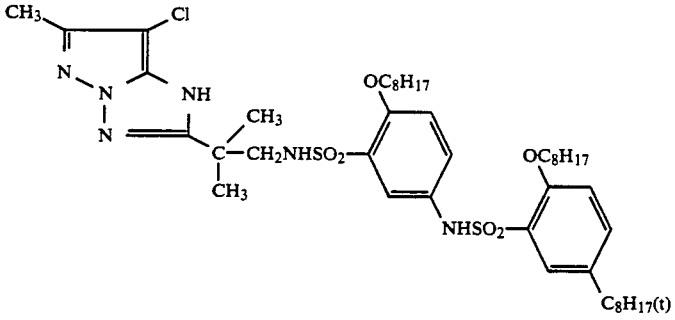
(M-7)
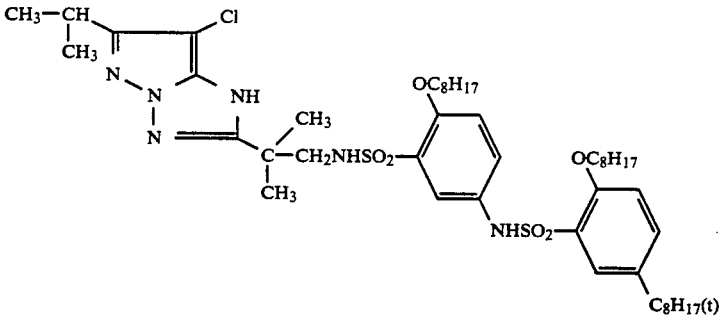
(M-8)
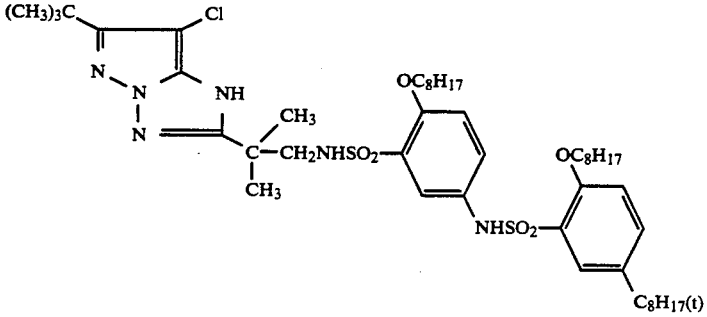
(M-9)

-continued
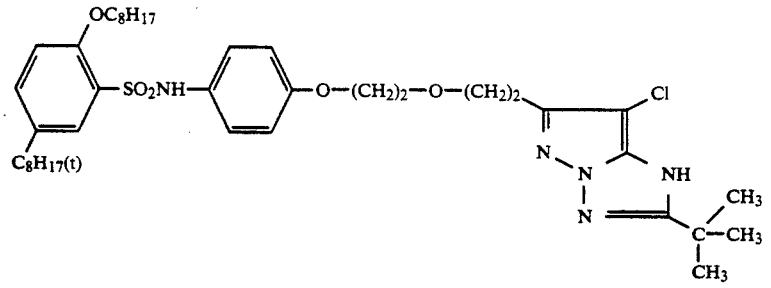
(M-10)
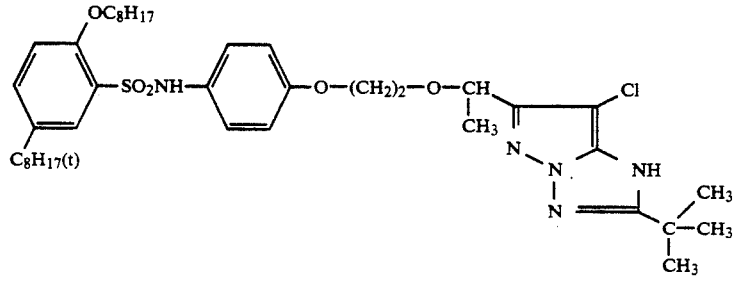
(M-11)
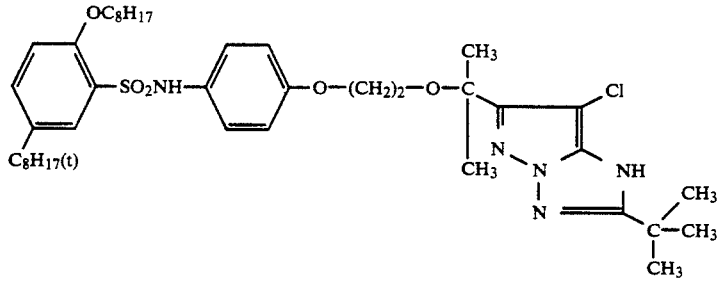
(M-12)
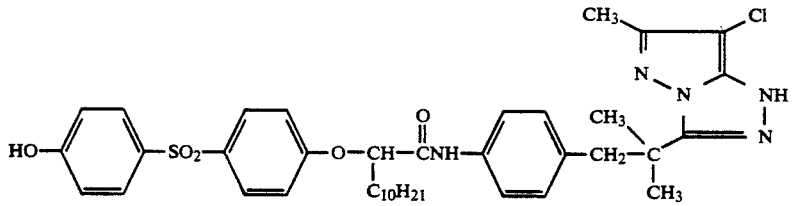
(M-13)
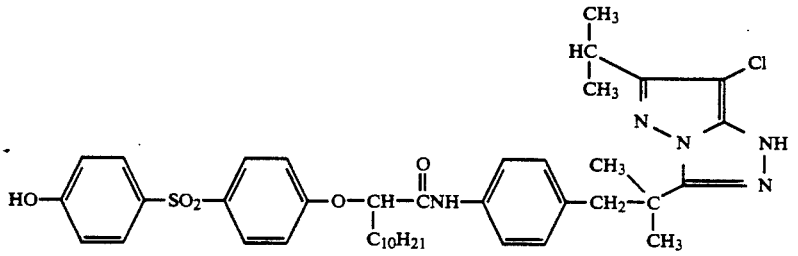
(M-14)

-continued
(M-15)
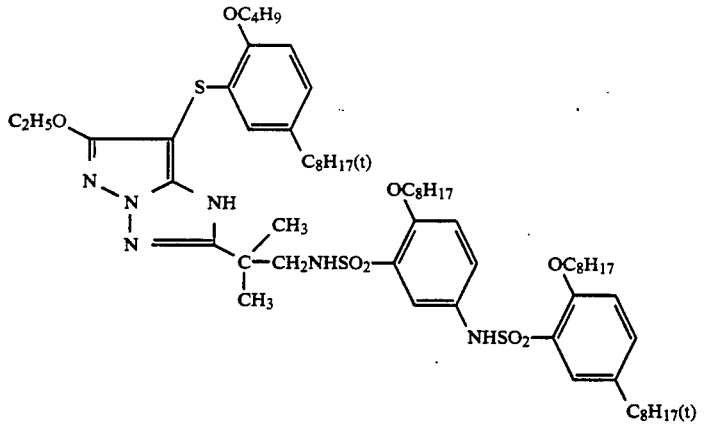
(M-16)
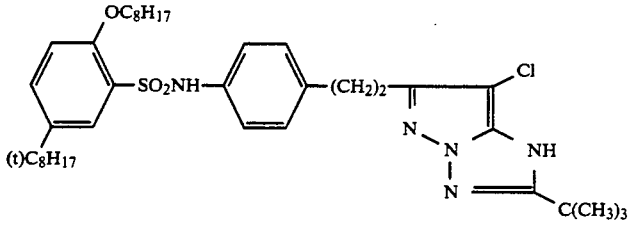
(M-17)
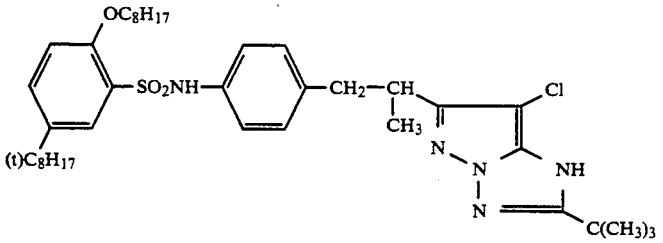
(M-18)
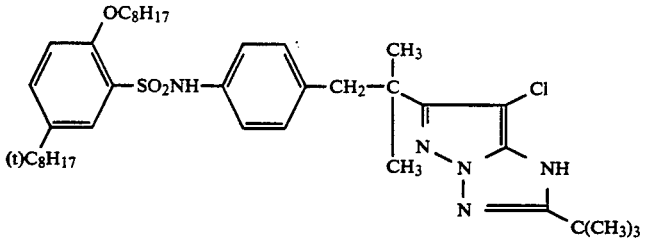
(M-19)
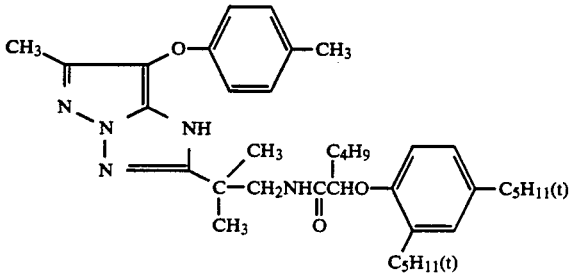

-continued
(M-20)
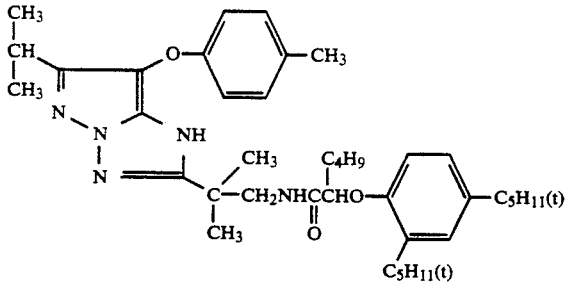
(M-21)
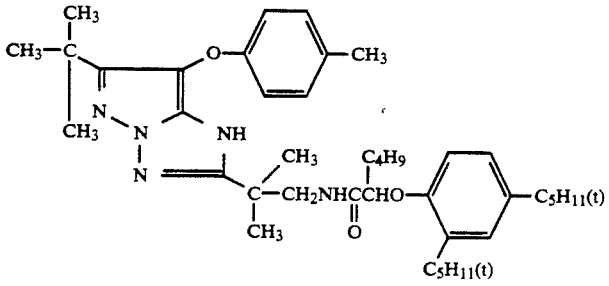
(M-22)
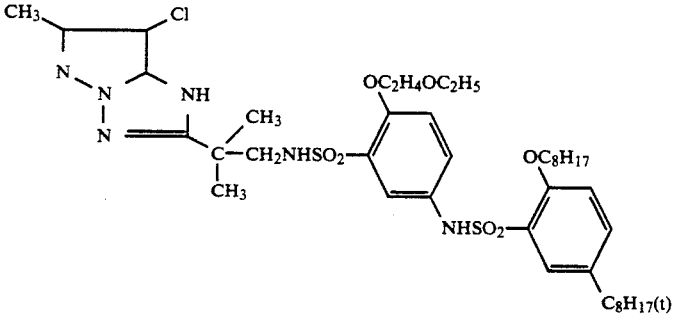
(M-23)
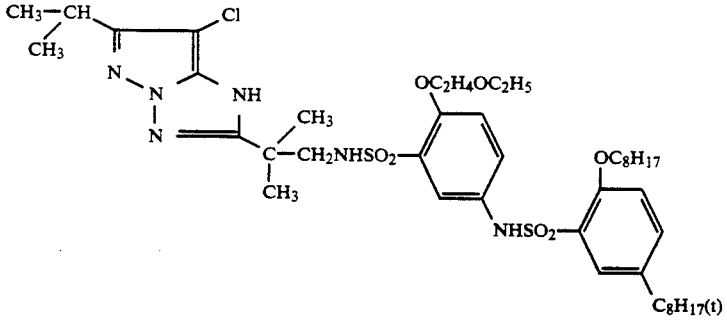
(M-24)
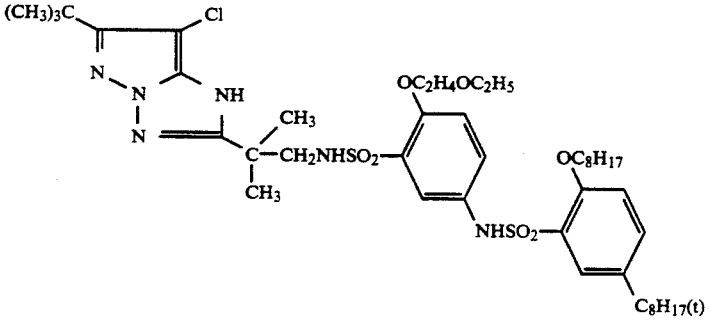

-continued
(M-25)
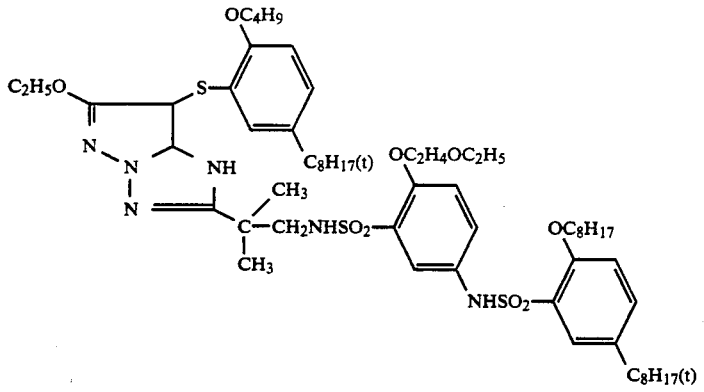
(M-26)
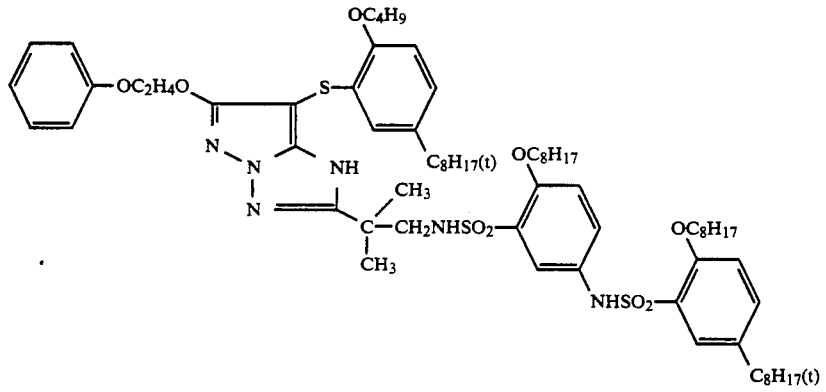
(M-27)
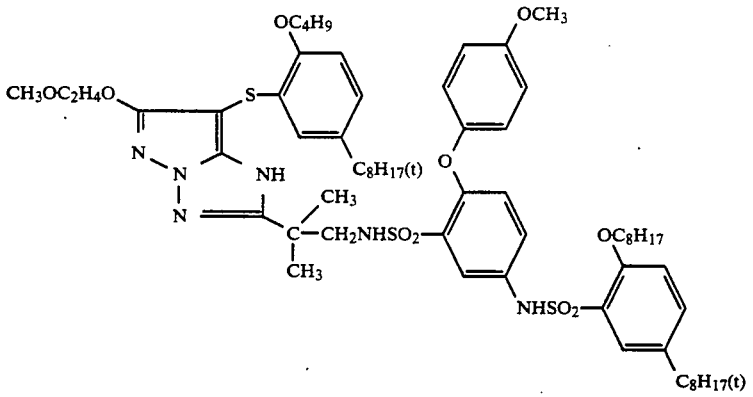
(M-28)
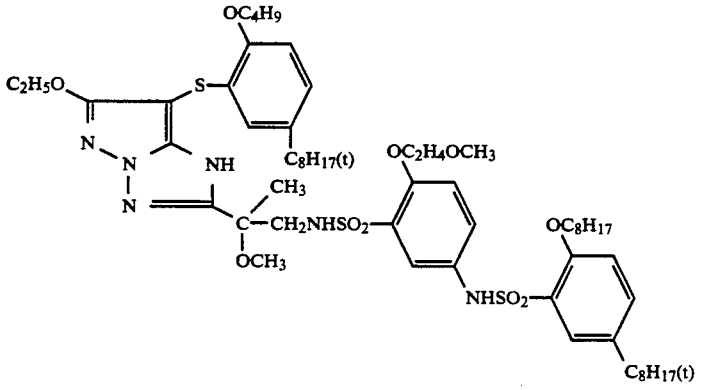

-continued (M-29)

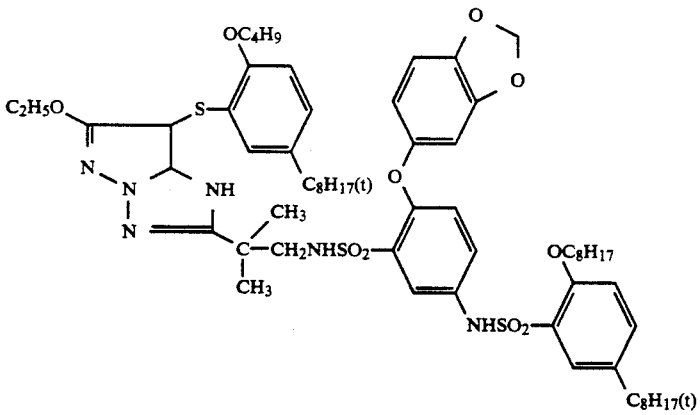

The couplers of the present invention can be synthesized by applying the methods described in Japanese Patent Application (OPI) Nos. 190779/85 and 197688/85 to the present case. A synthesis example is described below.

SYNTHESIS EXAMPLE

Synthesis of Compound (M-1)

97 g of 3-amino-5-methylpyrazole and 297 g of 2,2-dimethyl-3-phthalimidopropionimido acid methyl ester hydrochloride were stirred in methanol for about 1 hour at room temperature. Thereto, an aqueous solution containing a mixture of 70 g of hydroxylamine hydrochloride and 82 g of sodium acetate was added, and refluxed with heating over a period of about 5 hours. Then, the reaction mixture was poured into water to precipitate N-[3-(2H-5-methylpyrazolyl)]-2,2-dimethyl-3-phthalimidopropanamidoxime. The precipitate was filtered off, and washed with acetonitrile/water (1:1) mixed solvent. Yield: 174 g (yield rate: 51%). Melting Point: 110°-113° C.

A 100 g portion of the thus-obtained amidoxime was added to 700 mλ of acetonitrile and thereto an acetonitrile solution containing 56 g of p-toluenesulfonyl chloride was slowly added dropwise with stirring under room temperature. After conclusion of the dropwise addition, 23.5 mλ of pyridine was further added, and the stirring was continued for additional 1 hour. Then, the reaction mixture was poured into 2 liters of ice-cold water and thereby crystals separated out. The crystals were filtered off, and washed with acetonitrile/water (1:2) mixed solvent. Without drying the crystals, 1 liter of methanol and 22 mλ of pyridine were successively added to the crystals, and refluxed for about 2 hours with heating. Thereafter, methanol was distilled away under reduced pressure until the solution was concentrated to about 200 mλ. The concentrate was poured into about 500 mλ of water, and stirred for some time. Crystals thus-deposited were filtered off, washed with acetonitrile, and dried. Thereupon, 66 g of 6-methyl-2(2,2-dimethyl-2-phthalimidoethyl)-1H-pyrazolo[1,5-b][1,2,4]triazole was obtained. Yield Rate: 70%. Melting Point: 197°-199° C.

To a 50 g portion of the above-described pyrazolotriazole were added 100 mλ of methanol and 9 mλ of 85% hydrazine hydrate. The mixture was refluxed for about 2 hours with heating and thereto 100 mλ of water and 20 m( of concentrated hydrochloric acid were added. Phthalhydrazide thus precipitated was filtered out, and the filtrate was concentrated. The residue was recrystallized from ethanol. Thus, 31 g of 6-methyl-2-(1,1-dimethyl-2-aminoethyl)-1H-pyrazolo[1,5-b][1,2,4]triazole dihydrochloride was obtained. Yield Rate: 75%. Melting Point: 115° C. (in sealed tube).

A 30 g portion of this hydrochloride was dissolved in 60 mλ of acetamide and thereto 15.7 mλ of triethylamine was added. The mixture was cooled in an ice bath, and stirred thoroughly. Thereto, an acetonitrile solution containing 47 g of 5-t-octyl-2-n-octyloxybenzenesulfonyl chloride was added dropwise. The reaction mixture was poured into water, and extracted with ethyl acetate three times. The extract was dried over magnesium sulfate, and further evaporated to dryness under reduced pressure. The resulting solid was recrystallized from a mixed solvent of n-hexane and ethyl acetate. Thus, 48.5 g of 6-methyl-2-[1,1-dimethyl-2-(5-t-octyl-2-n-octylbenzenesulfonamido)ethyl-1H-pyrazolo[1,5-b][1,2,4]triazole was obtained. Yield Rate: 75%. Melting Point: 130°-140° C.

A 30 g portion of this pyrazolotriazole was dissolved in 40 mλ of dichloromethane and thereto 7.0 g of N-chlorosuccinimide was added and stirred under room temperature. After a 30 minute lapse, the reaction mixture was washed twice with water, and further once with a saturated solution of sodium chloride. After drying over magnesium sulfate, the product was concentrated to dryness, and recrystallized from a mixed solvent of n-hexane and ethyl acetate to yield 28.6 g of Compound (M-1). Yield Rate: 90%. Melting Point: 115° to 117° C.

Other illustrated compounds could also be synthesized using combinations of 3-amino-5-substituted pyrazoles and imino acid methyl ester hydrochlorides having substituent groups capable of deriving to intended couplers according to the above-described process.

The present coupler represented by general formula (I) is added to an emulsion layer in an amount of from $1\times10^{-3}$ to 1 mol, preferably from $5\times10^{-2}$ to $5\times10^{-1}$ mol, per mol of silver halide present in the same layer. Also, two or more of the present couplers may be incorporated in one emulsion layer.

In addition to the above-described magenta couplers, cyan couplers and yellow couplers can be used in the present invention.

Typical examples of these couplers include naphthol or phenol compounds, and open chain or heterocyclic ketomethylene compounds. Specific examples of such cyan and yellow couplers which can be used in the present invention are described in the patents cited in

*Research Disclosure*, No. 17643, Section VII-D (December, 1978) and ibid., No. 18716 (November, 1979).

It is desirable that color couplers to be incorporated in the light-sensitive material are rendered nondiffusible by containing a ballast group or taking a polymerized form. Moreover, 2-equivalent color couplers which have a coupling-off group at the coupling active site are preferred to 4-equivalent couplers having a hydrogen atom at that site because a coverage of silver can be reduced. Couplers which can be converted to dyes having a moderate diffusibility as a result of color development, colorless couplers, DIR couplers which can release development inhibitors in proportion as the coupling reaction proceeds, and couplers capable of releasing development accelerators upon the coupling reaction can also be employed.

As the representatives of the yellow couplers which can be used in the present invention, oil-protected acylacetamido couplers can be employed. Specific examples of such couplers are described in U.S. Pat. Nos. 2,407,210, 2,875,057 and 3,265,506 and so on. In the present invention, 2-equivalent yellow couplers are preferably employed, and typical representative couplers are yellow couplers having a coupling-off group containing an oxygen atom as a coupling-off atom as described, e.g., in U.S. Pat. Nos. 3,408,194, 3,447,928, 3,933,501 and 4,022,620, and yellow couplers having a coupling-off groups containing a nitrogen atom as a coupling-off atom as described, e.g., in Japanese Patent Publication No. 10739/83, U.S. Pat. Nos. 4,401,752 and 4,326,024, *Research Disclosure*, No. 18053 (April, 1979), British Patent 1,425,020, West German Patent Application (OLS) Nos. 2,219,917, 2,261,361, 2,329,587 and 2,433,812. Of these yellow couplers, α-pivaloylacetanilide couplers are more advantageous because they can produce fast dyes, especially excellent in fastness to light, and α-benzoylacetanilide couplers have an advantage in that they can ensure high color density to developed image.

Cyan couplers which can be used together in the present invention include couplers of oil-protected naphthol and phenol type. The representatives of such couplers are naphthol couplers described in U.S. Pat. No. 2,474,293, and more preferably 2-equivalent naphthol type couplers having a coupling-off group containing an oxygen atom as a coupling-off atom described in U.S. Pat. Nos. 4,052,212, 4,146,396, 4,228,233 and 4,296,200. And specific examples of the phenol type couplers are described in U.S. Pat. Nos. 2,369,929, 2,801,171, 2,772,162 and 2,895,826, and so on. Cyan couplers fast to moisture and temperature are preferably used in the present invention, and typical examples thereof include phenol type cyan couplers which have an alkyl group containing 2 or more carbon atoms at the meta-position of the phenol nucleus, as described in U.S. Pat. No. 3,772,002, 2,5-diacylamino-substituted phenol type couplers, as described in U.S. Pat. Nos. 2,772,162, 3,758,308, 4,126,396, 4,334,011 and 4,327,173, West German Patent Application (OLS) No. 3,329,729, Japanese Patent Application (OPI) No. 166956/84, and so on, and phenol couplers having a phenylureido group at the 2-position of their individual phenol nuclei and an acylamino group at the 5-position thereof, as described in U.S. Pat. Nos. 3,446,622, 4,333,999, 4,451,559 and 4,427,767, and so on.

Two or more of various kinds of couplers which can be used in the present invention can be incorporated in the same light-sensitive layer, or the same coupler can be incorporated in two or more different layers, depending on characteristics required of the light-sensitive material to be produced.

Couplers which can be used in the present invention can be introduced into a light-sensitive material using various known dispersing processes. A solid dispersing process, a caustic dispersing process, preferably a latex dispersing process, and more preferably an oil-in-water dispersing process are cited as typical instances. In an oil-in-water dispersing process, a coupler is dissolved in a single solvent of either a high boiling point organic solvent having a boiling point higher than 175° C. or a so-called auxiliary solvent having a low boiling point, or in a mixture of these solvents, and then finely dispersed into an aqueous medium such as water, an aqueous solution of gelatin or the like in the presence of a surface active agent. Suitable examples of high boiling point organic solvents are described, e.g., in U.S. Pat. No. 2,322,027, and so on.

Standard amounts of color couplers used are within the range of 0.001 to 1 mol per mol of light-sensitive silver halide. Preferably, yellow couplers are used in an amount of from 0.01 to 0.5 mol, and cyan couplers in an amount of from 0.002 to 0.3 mol, per mol of light-sensitive silver halide.

Silver halide emulsions which can be used in the present invention are prepared usually by mixing a solution of a water-soluble silver salt (e.g., silver nitrate) with a solution of a water-soluble halide (e.g., potassium bromide, sodium chloride, or a mixture thereof) in the presence of a solution of a water-soluble high polymer like gelatin. Typical examples of silver halides produced in the above-described manner include not only silver chlorobromide, but also pure silver chloride and pure silver bromide, which may contain some quantity of silver iodide. Silver halides employed preferably in the present invention are silver chloroiodobromide, silver iodochloride or silver iodobromide not containing an iodide content or, if any, containing an iodide content of 3 mol % or less. In particular, silver chlorobromide having a chloride content of 5 mol % or more is employed to advantage in the present invention. The interior and the surface of the silver halide grains may differ, the silver halide grains may have a multiphase structure in which many conjunct planes are present, or the silver halide grains may be homogeneous throughout. Silver halide grains of these kinds may be present together. Taking the case of silver chlorobromide grains having different phases, the grains may contain inside thereof a core, a single layer or plural layers rich in silver bromide, compared with the average halide composition. Also, the grains may contain inside thereof a core, a single layer or plural layers rich in silver chloride, compared with the average halide composition. It is in the case of silver chlorobromide emulsions having less iodide content and less chloride content that the couplers of the present invention can more fully achieve their advantages of causing no decrease in contrast, and so on, as contrasted with other pyrazoloazole couplers. A mean grain size of silver halide grains (the grain size as used herein refers to a grain diameter in the case of grains spherical or approximately spherical in shape, while it refers to an edge length in the case of cubic grains, in both cases, it is represented by the mean based on projected areas of the grains) is preferably not larger than 2 μm, and not smaller than 0.1 μm at that. Particularly preferably it ranges from 0.15 to 1 μm. The distribution of the grain size may be either narrow or broad.

So-called monodispersed silver halide emulsions, which have a narrow distribution of the grain size such that 90% or more, preferably 95% or more, of the grains have their individual sizes within the range of ±40% of the number average or the weight average grain size, can be employed in the present invention. In order to attain the aimed gradation, two or more of monodispersed silver halide emulsions having substantially the same color sensitivity but differing in grain size may be mixed and coated in a single layer, or they may be multiply coated sensitivity layers. In addition, two or more of polydispersed silver halide emulsions, or combinations of monodispersed emulsion and polydispersed emulsions can be coated in a single layer as a mixture, or multiply coated in separate layers.

The silver halide grains to be employed in the present invention may have a regular crystal form, such as a cube, an octahedron, a dodecahedron, or a tetradeca hedron, etc.; an irregular crystal form, such as a sphere, etc.; or a composite form of two or more thereof. Emulsions in which tabular silver halide grains, which have a length/thickness ratio of 5 or more, particularly 8 or more, are contained in a fraction of 50% or more on a basis of the total projected area of all grains may be employed in the present invention. An emulsion in which a mixture of these various crystal forms of silver halide grains are present may be used. These various emulsions may be either of a surface latent image type, in which a latent image is predominantly formed on surfaces of grains, or of an inner latent image type, in which a latent image is predominantly formed in the interior of the grains.

These photographic emulsions can be prepared using various methods as described, e.g., in P. Glafkides, *Chimie et Physique Photographique*, Paul Montel, Paris (1967), G.F. Duffin, *Photographic Emulsion Chemistry*, The Focal Press, London (1966), V.L. Zelikman et al., *Making and Coating Photographic Emulsion*, The Focal Press, London (1964) and so on. More specifically, any processes, e.g., the acid process, the neutral process, the ammoniacal process and so on, can be employed. Suitable methods for reacting a water-soluble silver salt with a water-soluble halide include, e.g., a single jet method, a double jet method or a combination thereof.

A so-called reverse mixing method, wherein grains are formed in the presence of an excess silver ion, can also be used. A transformation method, wherein a halide is added to produce more sparingly soluble silver halide grains than conventional silver halide grains, can be employed. Moreover, a so-called controlled double jet method, in which the pAg of the liquid phase in which silver halide grains are to be precipitated is maintained constant, may be employed. According to this method, silver halide emulsions having a regular crystal form and an almost uniform grain size can be obtained.

In a process of producing silver halide grains or allowing the produced silver halide grains to ripen physically, cadmium salts, zinc salts, lead salts, thallium salts, iridium salts or complexes thereof, rhodium salts or complexes thereof, iron salts or complexes thereof and/or the like may be present.

After conclusion of grain formation, the silver halide emulsion are, in general, subjected to physical ripening, desalting and chemical ripening, followed by coating.

In addition, at the time of precipitation, physical ripening or chemical ripening of these silver halide grains, well known silver halide solvents, such as ammonia, potassium rhodanide, and thioether and thione compounds (e.g., those described in U.S. Pat. No. 3,271,157, Japanese Patent Application (OPI) Nos. 12360/76, 82408/78, 144319/78, 100717/79 and 155828/79, and so on) can be used.

Removal of soluble salts from the physically ripened silver halide emulsion can be effected by using a noodle washing method, a flocculation precipitating method, an ultrafiltration method, or so on.

Silver halide emulsions to be employed in the present invention are chemically sensitized by a sulfur sensitization process utilizing active gelatin or compounds containing sulfur capable of reacting with silver ion (e.g., thiosulfates, thioureas, mercapto compounds, rhodanines, etc.), a reduction sensitization process using reducing materials (e.g., stannous salts, amines, hydrazine derivatives, formamidinesulfinic acid, silane compounds, etc.), a noble metal sensitization process using metal compounds (e.g., gold complexes, and complex salts of Group VIII metals such as Pt, Ir, Pd, Rh, Fe, etc.), and so on can be employed individually or as a combination thereof.

The photographic emulsions to be used in the present invention are spectrally sensitized by using photographic sensitizing dyes. Suitable sensitizing dyes which can be employed include cyanine dyes, merocyanine dyes, complex cyanine dyes, complex merocyanine dyes, holopolar cyanine dyes, hemicyanine dyes, styryl dyes and hemioxonol dyes.

These sensitizing dyes may be employed individually or in combination. Combinations of sensitizing dyes are often employed for the purpose of supersensitization.

Materials which can exhibit a supersensitizing effect in a combination with a certain sensitizing dye although they themselves do not absorb light in the visible region may be incorporated into the silver halide emulsion. For example, aminostilbene compounds substituted with nitrogen-containing heterocyclic groups (described, for example, in U.S. Pat. Nos. 2,933,390 and 3,635,721), aromatic organic acid-formaldehyde condensates (described, for example, in U.S. Pat. No. 3,743,510), cadmium salts, azaindene compounds and so on can be used.

A wide variety of compounds can be incorporated in the photographic emulsions to be used in the present invention for the purpose of preventing fogging or stabilizing photographic properties during production, storage or photographic processing.

The light-sensitive material of the present invention may contain as a color fog inhibitor or a color-mixing inhibitor hydroquinone derivatives, aminophenol phenol derivatives, amines, gallic acid derivatives, catechol derivatives, ascorbic acid derivatives, colorless couplers, sulfonamidophenol derivatives, and so on.

The light-sensitive material of the present invention can contain various kinds of discoloration inhibitors.

The light-sensitive material of the present invention can contain an ultraviolet absorbent in a hydrophilic colloid layer.

The light-sensitive material of the present invention may contain one or more kinds of a surface active agent for various purposes, for instance, as a coating aid, prevention of generation of static charges) improvement in slippability, emulsifying dispersion, prevention of generation of adhesion, improvement in photographic characteristics (e.g., acceleration of development, increase in contrast, sensitization, etc.) and so on.

In addition to the above-described additives, the light-sensitive material of the present invention may optionally contain various kinds of stabilizers, stain inhibitors, developing agents or precursors thereof, development accelerators or precursors thereof, lubricants, mordants, matting agents, antistatic agents, plasticizers, and other various additives useful for photographic light-sensitive materials. Typical representatives of such additives are described in *Research Disclosure*, No. 17643 (December, 1978), and ibid., No. 18716 (November, 1979).

The present invention can also be applied to a multilayer multicolor photographic material having at least two different color sensitivities on a support. A multilayer color photographic material has, in general, at least one red-sensitive emulsion layer, at least one green-sensitive emulsion layer and at least one blue-sensitive emulsion layer on a support. The order of these layers can be varied as desired. Each of the above-described emulsion layers may have two or more constituent layers differing in sensitivity, and a light-insensitive layer may be arranged between any two of the constituent layers having the same color sensitivity.

In addition to the above-described silver halide emulsion layers, it is desired to provide proper auxiliary layers, such as a protective layer, an interlayer, a filter layer, an antihalation layer, a backing layer and so on, in the light-sensitive material according to the present invention.

In the photographic light-sensitive material of the present invention, photographic emulsion layers and other layers are coated on a conventionally used flexible support, such as a plastic film, paper, cloth or the like, or a rigid support such as glass, ceramics, metals or so on. Of these supports, baryta paper or a paper support laminated with polyethylene film in which a white pigment (e.g., Titanium oxide) is dispersed is more preferred as the support of the present invention.

The silver halide color photographic material of the present invention are well suited to be used as sensitive materials for observing images directly, such as color paper, color reversal paper, color reversal films, color positive films for motion picture use, and so on.

A color developing solution to be used for development processing of the photographic material of the present invention is an alkaline aqueous solution containing preferably an aromatic primary amine type color developing agent as a main component. Preferred developing agents of such a type are p-phenylenediamine compounds. The representatives of such compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochloride or p-toluenesulfonates of the above-cited anilines.

In addition to preservatives such as sulfite of alkali metals and hydroxylamines, the color developing solution can generally contain pH buffering agents such as carbonates, borates or phosphates of alkali metals, and development inhibitors or antifoggants such as bromides, iodides, benzimidazoles, benzothiazoles or mercapto compounds. Further, organic solvents (e.g., benzyl alcohol, diethylene glycol, etc.), polyethylene glycol, quaternary ammonium salts, development accelerators like amines, and so on may be contained in the color developing solution.

After color development, the photographic emulsion layer is generally subjected to a bleach processing. The bleach processing may be carried out simultaneously with a fix processing, or separately therefrom.

Suitable examples of bleaching agents which can be used include compounds of polyvalent metals such as Fe (III), Co (III), Cr (VI), Cu (II), etc., peroxides, quinones, nitroso compounds and so on. Typical examples of bleaching agents which can be used include ferricyanides; bichromates; organic complex salts of Fe (III) or Co (III), for example, complex salts of organic acids such as aminopolycarboxylic acids (e.g., ethylenediaminetetraacetic acid, diethylenetriaminepentaacetic acid, nitrilotriacetic acid, 1,3-diamino-2-propanoltetraacetic acid, etc.), citric acid, tartaric acid, malic acid; persulfates; manganates; nitrosophenols, and so on. Of these complex salts, ethylenediaminetetraacetato ferrate (III) complex salts and persulfates are particularly preferred from the standpoint of rapid processing and prevention of environmental pollution. Ethylenediaminetetraacetato ferrate (III) complex salts are particularly useful in both independent bleaching solution and combined bleaching and fixing bath.

To a bleaching solution or a bleach-fix bath may be added various accelerators in combination, if necessary.

After bleach-fix processing or fix processing, a washing processing is generally carried out. In the step of washing, various known compounds may be added for the purpose of preventing precipitation and saving water. In order to prevent the precipitation from occurring, a water softener such as an inorganic phosphoric acid, an aminopolycarboxylic acid, an organic phosphonic acid, or so on; a germicide and a bactericide for inhibiting various bacteria, waterweeds and molds from breaking out; a hardener represented by a magnesium salt or an aluminum salt; a surface active agent for lightening a drying load and for preventing generation of drying mark; and so on can be added, if needed. Also, the compounds described in a literature entitled "Water Quality Criteria" by L.E. West in *Photo. Sci. Eng.*, Vol. 6, pp. 344 to 359 (1965) may be added. In particular, addition of chelating agents and bactericides is effective.

The washing step is, in general, carried out using two or more tanks according to the countercurrent washing method for the purpose of saving water. On the other hand, a multistage countercurrent stabilization processing step as described in Japanese Patent Application (OPI) No. 8543/82 may be carried out in place of the washing step. To the stabilizing bath are added various kinds of compounds in order to stabilize the developed images. As typical examples of such additives, mention may be made of various buffering agents for adjusting the film pH to a proper value (ranging generally from 3 to 8), such as those obtained by combining properly acids and alkalis selecting from among borates, metaborates, borax, phosphates, carbonates, potassium hydroxide, sodium hydroxide, aqueous ammonia, monocarboxylic acids, dicarboxylic acids, polycarboxylic acids and the like, and formaldehyde. The stabilizing bath may further contain a water softener (e.g., inorganic phosphoric acids, aminopolycarboxylic acids, organic phosphonic acids, aminopolyphosphonic acids, phosphocarboxylic acids, or so on), a germicide (e.g., benzisothiazolinone, isothiazolone, 4-thiazolinebenzimidazole, halogenophenols, or so on), a surface active agent, a brightening agent, a hardener and other various kinds of additives, if desired. Two or more kinds of compounds may be used for the same purpose or different purposes.

In addition, it is desired that various ammonium salts, such as ammonium chloride, ammonium nitrate, ammonium sulfate, ammonium phosphate, ammonium sulfite, ammonium thiosulfate and the like, should be added to the stabilizing bath in order to control the pH in the processed film.

A color developing agent may be incorporated into the silver halide color photographic material of the present invention for the purposes of simplifying and quickening the photographic processing. Incorporation of the color developing agent is carried out to advantage by using it in the form of precursor.

Further, various 1-phenyl-3-pyrazolidones may optionally be incorporated in the silver halide color photographic material of the present invention for the purpose of accelerating the color development.

Typical examples of such compounds are described in Japanese Patent Application (OPI) Nos. 64339/81, 144547/82, 211147/82, 50532/83, 50536/83, 50533/83, 50534/83, 50535/83, 115438/83, and so on.

Various kinds of processing solutions are used at a temperature ranging from 10° C. to 50° C. in the present invention. As for the developer, it is desirable for efficient development to use it at a temperature of from 33° C. to 38° C. For the purpose of saving silver upon production of light-sensitive materials, the step utilizing cobalt intensification or hydrogen peroxide intensification may be carried out.

Various kinds of processing baths may be equipped with a heater, a temperature sensor, a liquid surface sensor, a circulating pump, a filter, a floating cover, a squeezer, and so on.

This invention will now be illustrated in greater detail with reference to the following examples, but it should be understood that they are not intended to limit the present invention.

EXAMPLE 1

A sample was prepared by coating an emulsion layer described below and a protective layer on a transparent film support of cellulose triacetate.

To 10.5 g of Coupler (M-1) according to the present invention, 15 g of tricresyl phosphate and 20 mλ of ethyl acetate were added. The mixture was heated up to 60° C., and converted into a solution. The resulting solution was mixed with 100 mλ of an aqueous solution containing 10 g of gelatin and 1 g of sodium dodecylbenzenesulfonate, and vigorously stirred using a high speed stirrer to produce an emulsified dispersion. With all of the coupler dispersion obtained was admixed 150 g of a silver halide emulsion containing 7.5 g of gelatin and 0.1 mol of silver chlorobromide whose grain size was 0.45 μm and whose halide composition was 30 mol % chloride and 70 mol % bromide. To the resulting mixture, sodium salt of 2-hydroxy-4,6-dichloro-s-triazine was further added. The thus-prepared coating composition was coated together with a protective layer on the above-described support at a coverage of 0.004 mol/m$^2$, on a silver basis, to produce Sample A.

Sample B and Sample C were prepared in the same manner as Sample A except that Coupler (M-2) and Coupler (M-3) were used in place of Coupler (M-1), respectively, in equimolar amounts. Moreover, Samples D, E, F, G, H and I were prepared in the same manner as Sample A except that Comparative Couplers X-1, X-2, X-3, X-4, X-5 and X-6 were used in place of Coupler (M-1), respectively, in equimolar amounts.

Sensitometry was carried out by exposing each of Samples A to I to white light through an optical wedge, and then subjecting the samples to development processing in accordance with the following steps. The results obtained are shown in Table 1.

TABLE 1

| Sample | Coupler | Sensitivity | Gamma | Fog | Remarks |
|---|---|---|---|---|---|
| A | (M-1) | 100 | 3.23 | 0.02 | Invention |
| B | (M-2) | 106 | 3.28 | 0.02 | Invention |
| C | (M-3) | 112 | 3.36 | 0.02 | Invention |
| D | X-1 | 90 | 2.97 | 0.03 | Comparison |
| E | X-2 | 90 | 2.98 | 0.03 | Comparison |
| F | X-3 | 93 | 2.98 | 0.03 | Comparison |
| G | X-4 | 93 | 2.97 | 0.03 | Comparison |
| H | X-5 | 95 | 2.99 | 0.02 | Comparison |
| I | X-6 | 95 | 3.02 | 0.02 | Comparison |

In Table 1, Sensitivity is expressed in terms of a relative value of a reciprocal of an exposure amount required for providing a density of fog+1.0, taking the sensitivity of Sample A as 100, and Gamma represents a gradient of a line connecting two points corresponding to a density of 1.0 and a density of 1.5 on a characteristic curve.

Samples A, B and C according to the present invention demonstrated higher sensitivity, higher contrast and more excellent color developability than other samples. Of the samples of the present invention, Sample B has turned out to be superior to Sample A in sensitivity and gradient, and Sample C has turned out to be superior to Sample B in sensitivity and gradient.

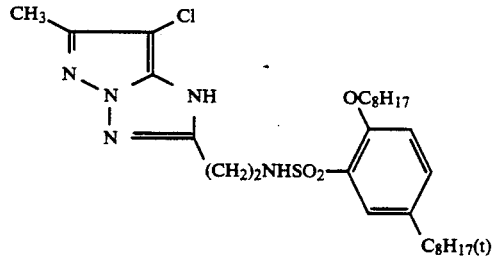

X-1

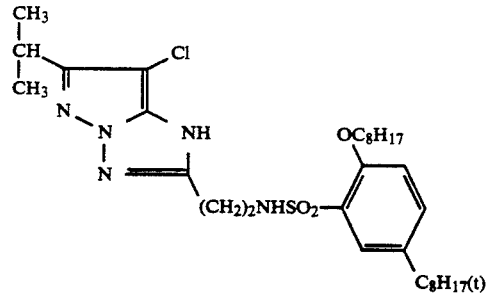

X-2

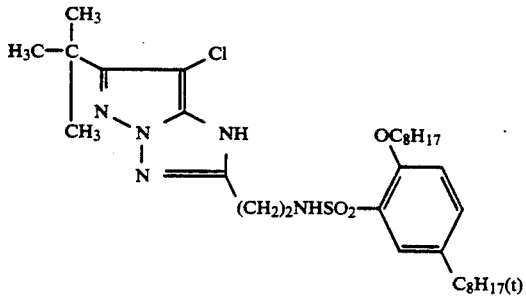

X-3

-continued

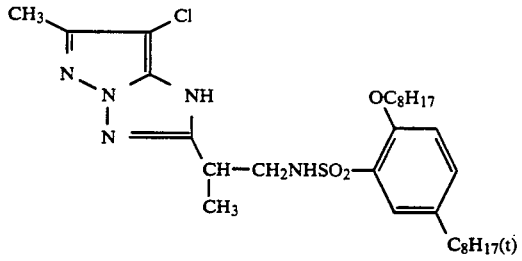

X-4

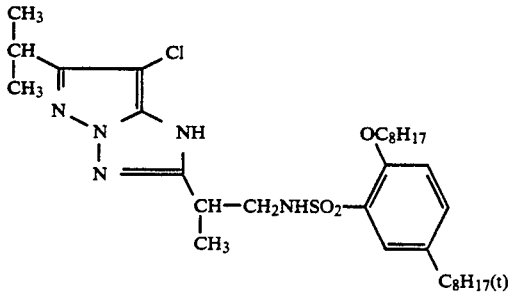

X-5

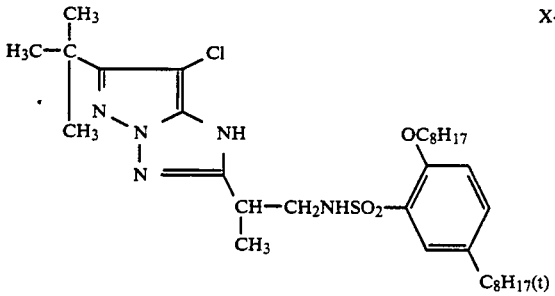

X-6

| Processing Steps (33° C.) | |
|---|---|
| Color Development | 3 min 30 sec |
| Bleach-Fix | 1 min 30 sec |
| Washing | 3 min |
| Drying | 10 min |

Compositions of the processing solutions used in the above-described steps respectively were described below.

| Developer: | |
|---|---|
| Diethylenetriaminepentaacetic Acid | 1.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-2-methyl-N-ethyl-N-[β-(methanesulfonamido)ethyl]-p-phenylenediamine Sulfate | 5.0 g |
| $Na_2CO_3$ (monohydrate) | 30 g |
| Brightening Agent (4,4'-diaminostilbene type) | 1.0 g |

-continued

| | |
|---|---|
| Water to make | 1 liter (pH 10.1) |
| Bleach-Fix Bath: | |
| Ammonium Thiosulfate (70 wt %) | 150 ml |
| $Na_2SO_3$ | 15 g |
| $NH_4[Fe(EDTA)]$ | 55 g |
| EDTA · 2 Na | 4 g |
| Water to make | 1 liter (pH 6.9) |

EXAMPLE 2

In 1,000 mλ of distilled water, 30 g of lime-processed gelatin and 5.5 g of sodium chloride were dissolved, and kept at 55° C. Thereto, a solution prepared by dissolving 125 g of silver nitrate in 1,500 m( of distilled water and a solution prepared by dissolving 8.8 g of potassium bromide and 38.8 g of sodium chloride in 600 mλ of distilled water were added dropwise over a period of 75 minutes with stirring. The resulting emulsion was desalted, washed with water, and chemically sensitized with sodium thiosulfate. Thus, 1,000 g of Emulsion a was obtained.

Similarly, 30 g of lime-processed gelatin and 5.5 g of sodium chloride were dissolved in 1,000 m( of distilled water, and kept at 65° C. Thereto, a solution prepared by dissolving 125 g of silver nitrate in 1,500 m( of distilled water and a solution prepared by dissolving 43.8 g of potassium bromide and 21.6 g of sodium chloride in 600 mλ of distilled water were added dropwise over a period of 75 minutes with stirring. The resulting emulsion was desalted, washed with water, and chemically sensitized with sodium thiosulfate. Thus, 1,000 g of Emulsion b was obtained.

In a similar manner as above, 30 g of lime-processed gelatin and 5.5 g of sodium chloride were dissolved in 1,000 m( of distilled water, and kept at 75° C. Thereto, a solution prepared by dissolving 125 g of silver nitrate in 1,500 mλ of distilled water and a solution prepared by dissolving 78.8 g of potassium bromide and 4.4 g of sodium chloride were added dropwise over a period of 75 minutes with stirring. The resulting emulsion was desalted, washed with water, and chemically sensitized with sodium thiosulfate. Thus, 1,000 g of Emulsion c was obtained.

To 16.3 g of Coupler (M-9) according to the present invention, 15 g of tricresyl phosphate and 20 mλ of ethyl acetate were added. The mixture was heated to 60° C., and converted into a solution. The resulting solution was mixed with 100 mλ of an aqueous solution containing 10 g of gelatin and 1 g of sodium dodecylbenzenesulfonate, and stirred vigorously using a high speed stirrer to prepare Emulsified Dispersion (i).

In addition, Emulsified Dispersions (ii) and (iii) were prepared in the same manner as Emulsified Dispersion (i) except that Comparative Couplers X-7 and X-8 respectively were used in place of Coupler (M-9) in equimolar amounts.

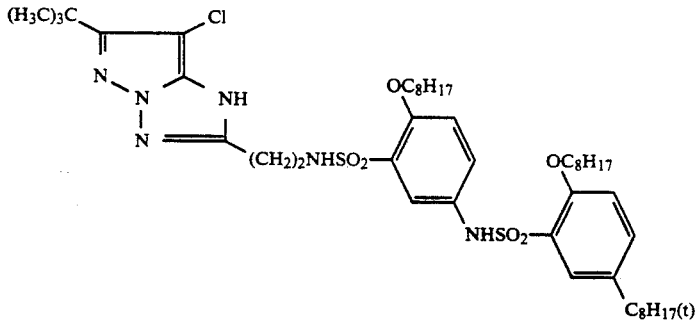

X-7

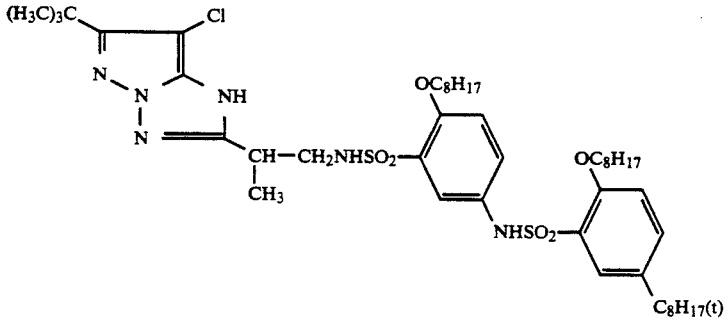

X-8

Each of these Emulsified Dispersions (i), (ii) and (iii) was combined and mixed with 135 g portions of the above-described Emulsions a, b and c respectively, and thereto was further added sodium salt of 2-hydroxy-4,6-dichloro-s-triazine. Each of the resulting emulsions was coated on a transparent film support of cellulose triacetate at a silver coverage of 0.004 mol/m$^2$. A protective layer was also provided simultaneously with the emulsion coat. The thus-obtained materials were named Samples J to R.

Each of Samples J to R was exposed to white light through an optical wedge, and development-processed in the same manner as in Example 1. The results obtained are shown in Table 2.

TABLE 2

| Sample | Emulsion | AgCl Content (mol %) | Emulsified Dispersion | Coupler | Sensitivity | Gamma | Fog | Remarks |
|---|---|---|---|---|---|---|---|---|
| J | a | 90 | (i) | (M-9) | 58 | 3.35 | 0.05 | Invention |
| K | b | 50 | (i) | (M-9) | 71 | 3.40 | 0.03 | Invention |
| L | c | 10 | (i) | (M-9) | 100 | 3.20 | 0.02 | Invention |
| M | a | 90 | (ii) | X-7 | 46 | 2.45 | 0.07 | Comparison |
| N | b | 50 | (ii) | X-7 | 59 | 2.90 | 0.03 | Comparison |
| O | c | 10 | (ii) | X-7 | 87 | 3.02 | 0.02 | Comparison |
| P | a | 90 | (iii) | X-8 | 49 | 2.88 | 0.06 | Comparison |
| Q | b | 50 | (iii) | X-8 | 62 | 3.10 | 0.03 | Comparison |
| R | c | 10 | (iii) | X-8 | 91 | 3.08 | 0.02 | Comparison |

The terms Sensitivity and Gamma in Table 2 have the same definitions as in Table 1 respectively, and the sensitivity of Sample L was taken as 100.

When the Comparative Couplers X-7 and X-8 were employed, a sharp drop in gamma was caused in Emulsion a and Emulsion b in which the silver chloride content was high, while when Coupler (M-9) of the present invention was employed no drop in gamma was observed in such emulsions, and what is more, gamma values equivalent to or higher than that of Emulsion c having a low silver chloride content were achieved. Accordingly, the coupler of the present invention has proved to be apt to more fully achieve its effects on emulsions having high silver chloride contents.

EXAMPLE 3

On a paper support laminated with polyethylene on both sides were coated from the first layer to the seventh layer described below to prepare a color light-sensitive material. The polyethylene laminate provided on the side where the first layer was coated contained titanium dioxide and a slight amount of ultramarine.

Numbers corresponding to the following ingredients describe a coverage expressed in terms of g/m$^2$. As for the silver halide, the coverage thereof is based on silver.

| | |
|---|---|
| **First Layer: Blue-Sensitive Layer** | |
| Silver chlorobromide emulsion (bromide content: 80 mol %) | 0.30 (silver) |
| Yellow coupler (*1) | 0.70 |
| Coupler solvent (TNP) for the above | 0.15 |
| Gelatin | 1.20 |
| **Second Layer: Interlayer** | |
| Gelatin | 0.90 |
| Di-t-octylhydroquinone | 0.05 |
| Solvent (DBP) for the above | 0.10 |
| **Third Layer: Green-Sensitive Layer** | |
| Silver chlorobromide emulsion prepared in Example 1 | 0.22 (silver) |
| Magenta Coupler (M-16) | 0.43 |
| Coupler solvent (TOP) for the above | 0.43 |
| Discoloration inhibitor (*2) | 0.20 |
| Gelatin | 1.00 |

-continued

| | |
|---|---|
| **Fourth Layer: Ultraviolet-Absorbing Interlayer** | |
| Ultraviolet abosrbent (*3/*4/*5) | 0.06/0.25/0.25 |
| Solvent (TNP) for the above | 0.20 |
| Gelatin | 1.5 |
| **Fifth Layer: Red-Sensitive Layer** | |
| Silver chlorobromide emulsion (bromide content: 70 mol %) | 0.20 (silver) |
| Cyan coupler (*6/*7) | 0.2/0.2 |
| Coupler solvent (TNP/DBP) for the above | 0.10/0.20 |
| Gelatin | 0.9 |
| **Sixth Layer: Ultraviolet Absorbing Interlayer** | |
| Ultraviolet absorbent (*3/*4/*5) | 0.06/0.25/0.25 |
| Solvent (DBP) for the above | 0.20 |
| Gelatin | 1.5 |
| **Seventh Layer: Protective Layer** | |
| Gelatin | 1.5 |

Therein, DBP represents dibutyl phthalate, TOP represents tri(n-octyl) phosphate, and TNP represents tri(n-nonyl) phosphate.

(*1)

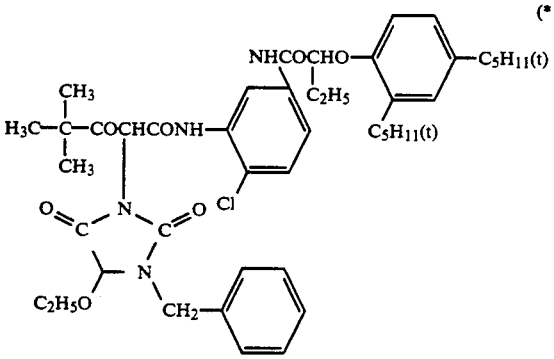

(*2)

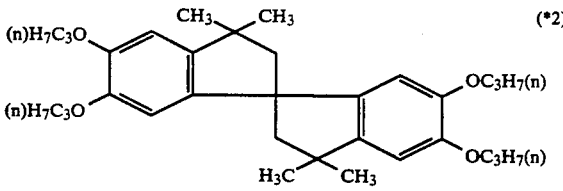

(*3)

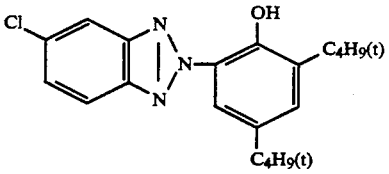

(*4)

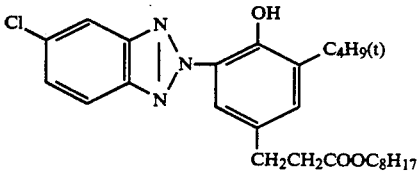

-continued (*5)

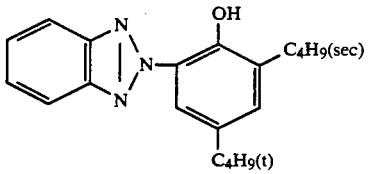

(*6)

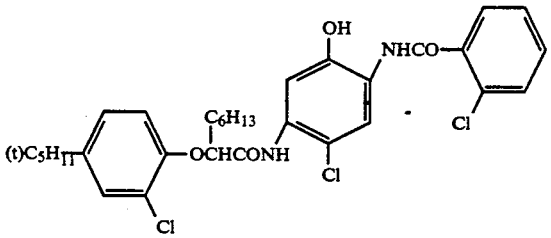

(*7)

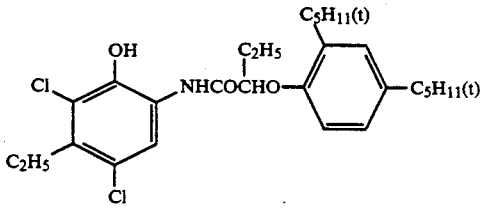

In the emulsion layers, the following dyes were employed as their respective spectral sensitizers.

Blue-Sensitive Emulsion Layer

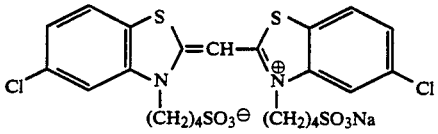

(the amount added was $2\times10^{-4}$ mol per mol of silver halide)

Green-Sensitive Emulsion Layer

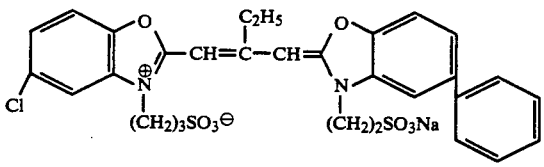

(The amount added was $2.5\times10^{-4}$ mol per mol of silver halide)

Red-Sensitive Emulsion Layer

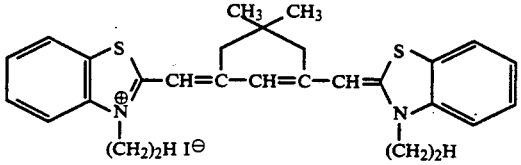

(The amount added was $2.5\times10^{-4}$ mol per mol of silver halide)

In each emulsion, the following dye was incorporated as anti-irradiation dye.

Green-Sensitive Emulsion Layer

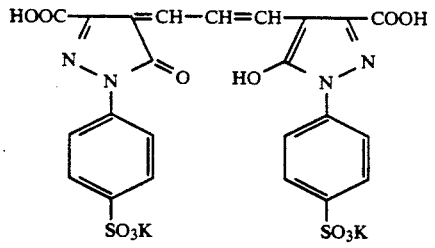

Red-Sensitive Emulsion Layer

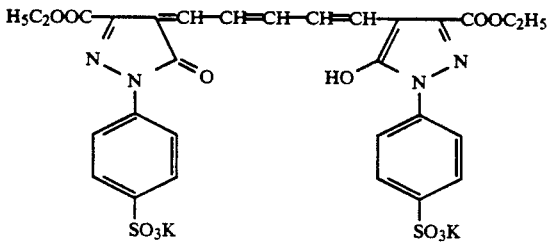

The thus-obtained sample was named Sample S. Other Samples T and U were produced in the same manner as Sample S except that equimolar amounts of (M-17) and (M-18) respectively replaced (M-16) as the magenta coupler incorporated in the third layer. In addition, Samples V, W and X were produced in the same manner as Sample S except that Comparative Couplers X-9, X-10 and X-11, which are illustrated below, respectively replaced (M-16).

These samples were exposed to green light through an optical wedge, and development-processed in the same manner as in Example 1. The results obtained are shown in Table 3.

X-9

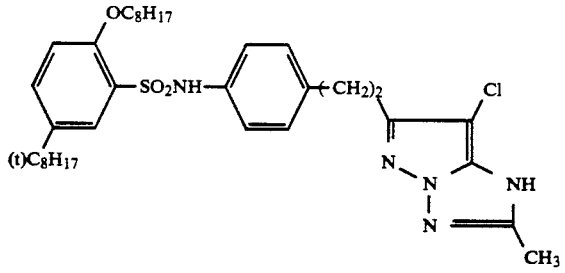

X-10

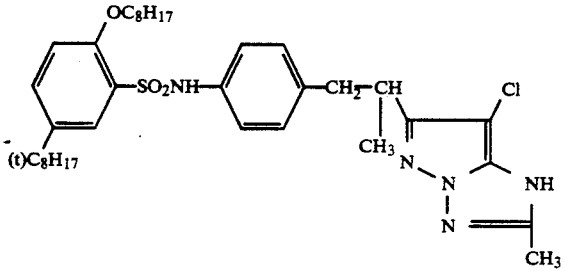

-continued

X-11

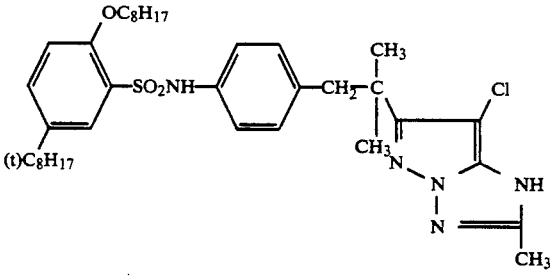

TABLE 3

| Sample | Coupler | Sensitivity | Gamma | Fog | Remarks |
|---|---|---|---|---|---|
| S | (M-16) | 100 | 2.76 | 0.05 | Invention |
| T | (M-17) | 100 | 2.80 | 0.05 | Invention |
| U | (M-18) | 104 | 2.92 | 0.05 | Invention |
| V | X-9 | 85 | 2.34 | 0.05 | Comparison |
| W | X-10 | 89 | 2.47 | 0.05 | Comparison |
| X | X-11 | 93 | 2.62 | 0.05 | Comparison |

The sensitivity and gamma values were determined by the same measurements as in Example 1. The sensitivities are shown as relative values, with Sample S being taken as 100.

As can be seen from the results set forth in Table 3, all the samples of the present invention, Samples S, T and U, demonstrated higher sensitivities and higher gammas than Comparative Samples V, W and X, that is, they had properties superior to those of the comparative samples.

Further, it has turned out that among the samples of the present invention Sample T had more excellent properties than Sample S, and Sample U was more excellent than Sample T in photographic properties. A similar tendency was observed among the comparative samples. In comparison, however, Comparative Sample X was inferior to Sample S of the present invention.

As is evident from the results set forth in Tables 1 to 3, the present invention enables production of color photographs of high sensitivity and high gamma without accompanied by increase in fog.

EXAMPLE 4

On a paper support laminated with polyethylene on both sides were coated the layers described below to prepare a multilayer multicolor photographic printing paper. Coating compositions for forming constituent layers were prepared as follows:

Preparation of a coating composition for the first layer was illustrated in detail below.

To a mixture of 19.1 g of Yellow Coupler (a) and 4.4 g of Color Image Stabilizer (b) were added 27.2 mλ of ethyl acetate and 7.9 mλ of Solvent (c) to prepare a solution. This solution was dispersed, in an emulsified condition, into 185 m( of a 10% gelatin aqueous solution containing 8 mλ of a 10% water solution of sodium dodecylbenzenesulfonate. Separately, a blue-sensitive sensitizing dye as illustrated below was added to a silver chlorobromide emulsion (bromide content: 1.0 mol %, silver content: 70 g per kg of emulsion) in an amount of $5.0\times10^{-4}$ mol per mol of silver. The resulting emulsion was mixed homogeneously with the foregoing emulsified dispersion so as to have the composition for the first layer described below.

In analogy with the first layer, the second to seventh layers were prepared.

In each of the layers, sodium salt of 1-oxy-3,5-dichloro-s-triazine was used as a gelatin hardener.

In the emulsion layers, the following dyes were employed as their respective spectral sensitizers.

Blue-Sensitive Emulsion Layer

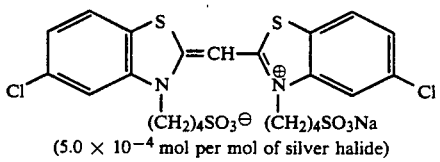

($5.0\times10^{-4}$ mol per mol of silver halide)

Green-Sensitive Emulsion Layer

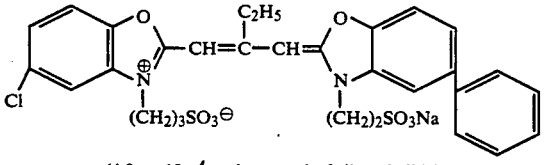

($4.0\times10^{-4}$ mol per mol of silver halide)

and

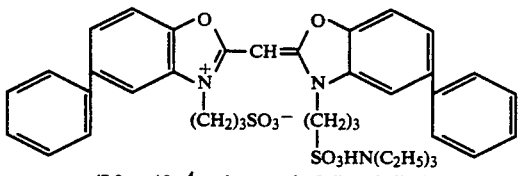

($7.0\times10^{-4}$ mol per mol of silver halide)

Red-Sensitive Emulsion Layer

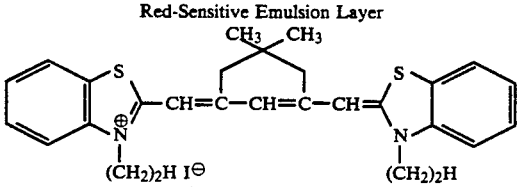

($0.9\times10^{-4}$ mol per mol of silver halide)

To the resd-sensitive emulsion layer, a 4,4'-bis[2,6-di(2-naphthoxy)pyrimidin-4-yl-amino]stilbene-2,2'-disulfonic acid was added in an amount of $2.6\times10^{-4}$ mol per mol of silver halide.

Furthermore, to the blue-sensitive emulsion layer, the green-sensitive emulsion layer and the red-sensitive emulsion layer, a 1-(5-methylureidophenyl)-5-mercaptotetorazole was added in an amount of $8.5\times10^{-5}$ mol, $7.7\times10^{-4}$ mol and $2.5\times10^{-4}$ mol per mol of silver halide, respectively.

For the purpose of preventing an irradiation phenomenon from occurring, the dyes used in Example 3 were added to each layer.

Structual formulae of couplers and other additives used in this example are illustrated below.

(a) Yellow Coupler

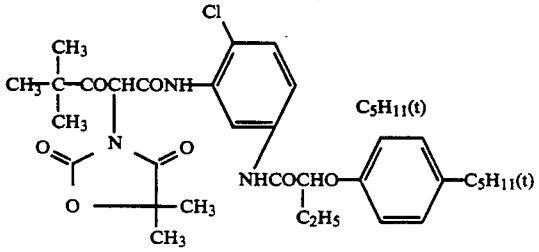

(b) Color Image Stabilizer

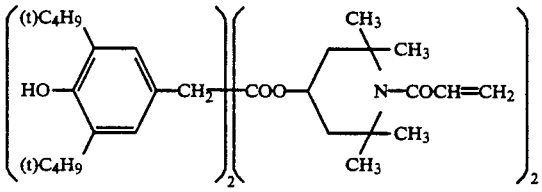

(c) Solvent

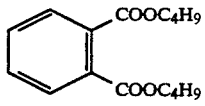

(d) Color Mixing Preventing Agent

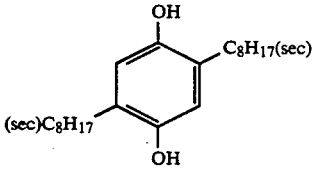

(e) Magenta Coupler

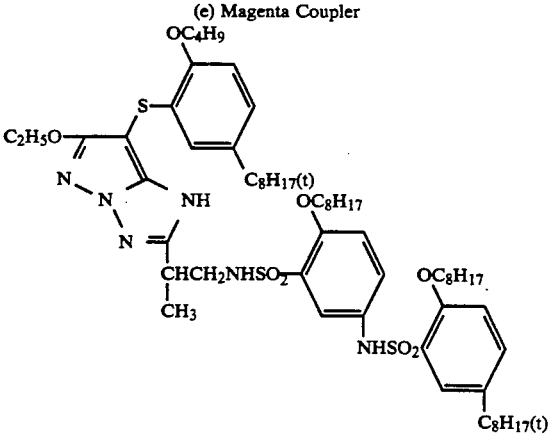

(f) Color Image Stabilizer

-continued

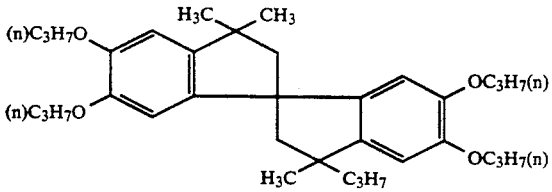

(g) Solvent
2:1 (by weight) mixture of
$(C_8H_{17}O)_3P{=}O$ and

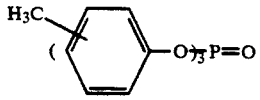

(h) Ultraviolet Absorbent
1:5:3 (by mol) mixture of

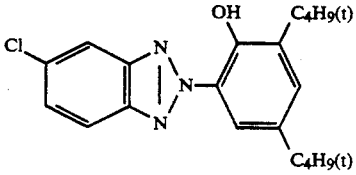

and

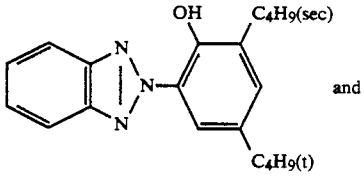

and

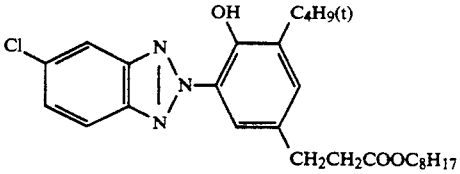

(i) Color Mixing Preventing Agent

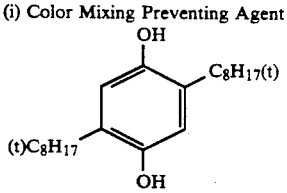

(j) Solvent
$(isoC_9H_{18}O)_3P{=}O$ (k) Cyan Coupler

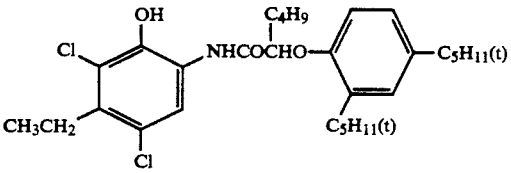

(l) Color Image Stabilizer
1:3:3 (by mol) mixture of

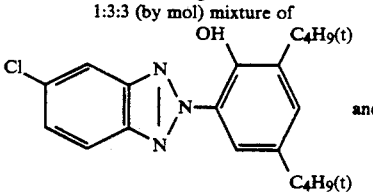

and

-continued

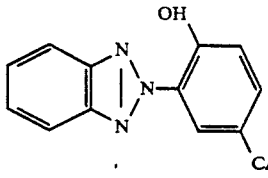

and

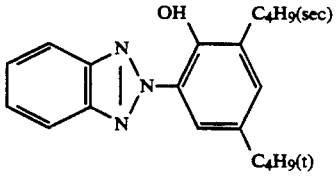

| | |
|---|---|
| **Seventh Layer: Protective Layer** | |
| Gelatin | 1.33 g/m$^2$ |
| Acryl denatured copolymer of polyvinyl alcohol (denaturing degree: 17%) | 0.17 g/m$^2$ |
| **Sixth Layer: Ultraviolet Absorbent Layer** | |
| Gelatin | 0.54 g/m$^2$ |
| Ultraviolet Absorbent (h) | 0.21 g/m$^2$ |
| Solvent (j) | 0.09 ml/m$^2$ |
| **Fifth Layer: Red-Sensitive Layer** | |
| Silver chlorobromide emulsion (bromide content: 0.4 mol %) | 0.24 g/m$^2$ |
| Gelatin | 0.96 g/m$^2$ |
| Cyan Coupler (k) | 0.38 g/m$^2$ |
| Color Image Stabilizer (l) | 0.17 g/m$^2$ |
| Solvent (c) | 0.23 ml/m$^2$ |
| **Fourth Layer: Ultraviolet Absorbent Layer** | |
| Gelatin | 1.60 g/m$^2$ |
| Ultraviolet Absorbent (h) | 0.62 g/m$^2$ |
| Color Mixing Preventing Agent (i) | 0.05 g/m$^2$ |
| Solvent (j) | 0.26 ml/m$^2$ |
| **Third Layer: Green-Sensitive Layer** | |
| Silver chlorobromide emulsion (bromide content: 0 mol %) | 0.16 g/m$^2$ |
| Gelatin | 1.80 g/m$^2$ |
| Magenta Coupler (e) | 0.45 g/m$^2$ |
| Color Image Stabilizer (f) | 0.20 g/m$^2$ |
| Solvent (g) | 0.45 ml/m$^2$ |
| **Second Layer: Color Mixing Preventing Layer** | |
| Gelatin | 0.99 g/m$^2$ |
| Color Mixing Preventing Agent (d) | 0.08 g/m$^2$ |
| **First Layer: Blue-Sensitive Layer** | |
| Silver chlorobromide emulsion (bromide content: 1.0 mol %) | 0.27 g/m$^2$ |
| Gelatin | 1.86 g/m$^2$ |
| Yellow Coupler (a) | 0.74 g/m$^2$ |
| Color Image Stabilizer (b) | 0.17 g/m$^2$ |
| Solvent (c) | 0.31 ml/m$^2$ |
| **Support:** | |
| Polyethylene laminated paper (containing $TiO_2$ and ultramarine in polyethylene laminate on first layer side) | |

Amounts of silver chlorobromide emulsions are based on silver coverage.

The color photographic paper thus obtained was exposed to light through an optical wedge, and subsequently subjected to the processing including the following steps.

| Processing Step | Time | Temperature (°C.) |
|---|---|---|
| Color Development | 45 sec | 35 |
| Bleach-Fix | 45 sec | 35 |
| Rinsing (4-tank cascade) | 1 min 30 sec | 30 |

-continued

| Processing Step | Time | Temperature (°C.) |
|---|---|---|
| Drying | 50 sec | 80 |

Compositions of the processing solutions used were as follows:

| | |
|---|---|
| Color Developer: | |
| Water | 800 ml |
| Diethylenetriaminepentaacetic Acid | 1.0 g |
| Sodium Sulfite | 0.2 g |
| N,N-Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N-Ethyl-N-(β-methanesulfonamidoethyl)-3-methyl-4-aminoaniline Sulfate | 4.5 g |
| Brightening Agent of 4,4'-Diaminostilbene Type (Whitex 4, trade name of Sumitomo Chemical Co., Ltd.) | 2.0 g |
| Water to make | 1,000 ml |
| KOH to adjust to pH | 10.25 |
| Bleach-Fix Solution: | |
| Water | 400 ml |
| Ammonium Thiosulfate (70%) | 150 ml |
| Sodium Sulfite | 18 g |
| Ammonium Ethylenediaminetetraacetato Ferrate | 55 g |
| Ethylenediaminetetraacetic Acid | 5 g |
| Water to make | 1,000 ml |
| pH adjusted to | 6.75 |
| Rinsing Solution: | |
| 1-Hydroxyethylidene-1,1-disulfonic Acid (60%) | 1.5 ml |
| Nitrilotriacetic Acid | 1.0 g |
| Ethylenediaminetetraacetic Acid | 0.5 g |
| Ethylenediamine-N,N,N',N'-tetramethylene-phosphonic Acid | 1.0 g |
| Bismuth Chloride (40%) | 0.5 g |
| Magnesium Sulfate | 0.2 g |
| Zinc Sulfate | 0.3 g |
| Ammonium Alum | 0.5 g |
| 5-Chloro-2-methyl-4-isothiazoline-3-one | 30 mg |
| 2-Methyl-4-isothiazoline-3-one | 10 mg |
| 2-Octyl-4-isothiazoline-3-one | 10 mg |
| Ethylene Glycol | 1.5 g |
| Sulfonyamide | 0.1 g |
| 1,2,3-Benzotriazole | 1.0 g |
| Ammonium Sulfite (40%) | 1.0 g |
| Aqueous Ammonia (26%) | 2.6 ml |
| Polyvinylpyrrolidone | 1.0 g |
| Brightening Agent of 4,4'-Diaminostilbene Type | 1.0 g |
| Water to make | 1,000 ml |
| KOH to adjust pH to | 7.0 |

As the silver chloride emulsion of the third layer, the below prepared emulsion was used.

30 g of lime processed gelatin was added to 1,000 mλ of distilled water and, after being dissolved at 40° C., 6.5 g of sodium chloride was added thereto and the temperature was elevated to 52.5° C. A solution of 62.5 g of silver nitrate dissolved in 750 ml of distilled water and a solution of 21.5 g of sodium chloride dissolved in 500 ml of distilled water were added to the previously prepared solution with stirring over a period of 40 minutes, while being kept at 52.5° C. Further, a solution of 62.5 g of silver nitrate dissolved in 500 ml of distilled water and a solution of 21.5 g of sodium chloride dissolved in 300 ml of distilled water were added thereto with stirring over a period of 20 minutes, while being kept at 52.5° C. At the stage of 2 minutes lapse after the conclusion of the addition, the above described green-sensitive sensitizing dye for the green-sensitive layer was added thereto. Thereafter, at the stage of 15 minutes lapse, the resulting emulsion was desalted and washed with water, and then $6\times10^{-6}$ mol of sodium thiosulfate per mol of silver was added thereto to subject to chemical sensitization.

The above prepared multilayer multicolor photographic printing paper was designated as Sample Y. Sample Z was as the same manner in Sample Y except that Magenta Coupler (M-15) was used in place of Magenta Coupler (e) of the third layer in equimolar amount.

These samples were exposed to light through an optical wedge, and development-processed in the same manner as in Example 1. The results obtained are shown in Table 4.

TABLE 4

| Sample | Coupler | Sensitivity | Gamma | Fog | Remarks |
|---|---|---|---|---|---|
| Y | (e) | 89 | 2.49 | 0.06 | Comparison |
| Z | (M-15) | 100 | 2.98 | 0.06 | Invention |

As can be seen from the results set forth in Table 4, Sample Z using Magenta Coupler (M-15) of the present invention demonstrated higher sensitivity and higher gamma than that of Sample Y using Magenta Coupler (e) showing comparatively good results, that is, Sample Z had properties superior to those of Sample Y.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon a silver halide emulsion layer containing a pyrazoloazole type coupler represented by general formula (II):

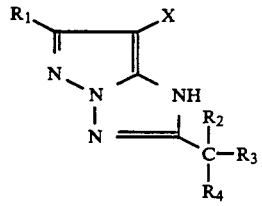

(II)

wherein X represents a hydrogen atom or a group releasable upon coupling with the oxidation product of an aromatic primary amine developing agent; $R_2$ represents an unsubstituted alkyl group; $R_3$ represents a substituted or unsubstituted alkyl group; $R_4$ represents an unsubstituted alkyl group; $R_2$ and $R_4$ may be the same or different; and $R_1$ is represented by

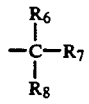

wherein $R_6$ has the same meaning as $R_2$, and $R_7$ and $R_8$ have the same meaning as $R_3$ and $R_4$, respectively.

2. A silver halide color photographic material of claim 1 wherein the substituent of said substituted alkyl group includes a sulfonamido group, an acylamino group and an aryl group each of which may have a substituent or substituents.

3. A silver halide color photographic material of claim 1, wherein silver halides having a chlorine content of 10 mol % or more are employed.

4. A silver halide color photographic material of claim 1 wherein silver halides are a silver chloride, a silver chlorobromide or a silver bromide which do not substantially contain an iodide content.

5. A silver halide color photographic material of claim 1, wherein the silver halide is a silver chlorobromide.

* * * * *